US010212965B2

(12) United States Patent
Sinclair, Jr. et al.

(10) Patent No.: US 10,212,965 B2
(45) Date of Patent: Feb. 26, 2019

(54) NESTED PACKAGED CONES WITH SUPPORTING SHAPE INSERTS PACKAGED IN A POUCH

(71) Applicant: BLUNT WRAP U.S.A., INC., Mandeville, LA (US)

(72) Inventors: Daniel S. Sinclair, Jr., Mandeville, LA (US); Pedro Almonte, Santiago (DO)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 86 days.

(21) Appl. No.: 15/062,940

(22) Filed: Mar. 7, 2016

(65) Prior Publication Data

US 2016/0270436 A1 Sep. 22, 2016

Related U.S. Application Data

(60) Provisional application No. 62/128,576, filed on Mar. 5, 2015.

(51) Int. Cl.

| | |
|---|---|
| ***A24D 1/02*** | (2006.01) |
| ***A24D 1/04*** | (2006.01) |
| ***A24F 15/12*** | (2006.01) |
| ***A24C 3/00*** | (2006.01) |
| ***A24C 1/30*** | (2006.01) |

(52) U.S. Cl.

CPC ..... *A24D 1/02* (2013.01); *A24C 1/30* (2013.01); *A24C 3/00* (2013.01); *A24D 1/022* (2013.01); *A24D 1/045* (2013.01); *A24F 15/12* (2013.01)

(58) Field of Classification Search

CPC ..... A24D 1/02; A24D 1/022; A24D 1/045; A24D 15/12; A24C 1/30; A24C 3/00

See application file for complete search history.

(56) References Cited

U.S. PATENT DOCUMENTS

| | | | |
|---|---|---|---|
| 1,145,268 | A | 7/1915 | Rossy |
| 1,479,458 | A | 1/1924 | De La Mota |
| 1,631,048 | A | 5/1927 | Miller |
| 1,995,068 | A | 3/1935 | Lim |
| 3,385,302 | A | 5/1968 | Wattenford |
| 4,104,431 | A | 8/1978 | Luke |

(Continued)

FOREIGN PATENT DOCUMENTS

| | | |
|---|---|---|
| DE | 9414404 | 2/1995 |
| DE | 19531061 | 2/1997 |

(Continued)

*Primary Examiner* — Edmund H Lee
*Assistant Examiner* — Jamel M Nelson
(74) *Attorney, Agent, or Firm* — Brett A. North

(57) ABSTRACT

A product and method of making thereof for the consumption of smokable substances such as tobacco or herbs. The product is comprised of tobacco, homogenized tobacco and/or natural leaf materials and has a hollow conical shape that allows for the easy insertion of smokable substances. Additionally, the conical or frustoconical shape of the product provides for larger amounts of smokable substances in the end of the product the consumer lights, resulting in an initial slower prolonged burn and more even distribution of nicotine. Additionally, placement of a supporting insert into the interior of the product supports the conical shaped of the product when packaged along with supporting during the process of being filled.

8 Claims, 32 Drawing Sheets

(56) References Cited

U.S. PATENT DOCUMENTS

| | | | | |
|---|---|---|---|---|
| 4,290,592 | A | 9/1981 | Kastner | |
| 4,775,358 | A | 10/1988 | Jones | |
| 4,832,057 | A | 5/1989 | Bale | |
| 5,464,073 | A | 11/1995 | Johannes | |
| 5,645,089 | A | 7/1997 | Burger et al. | |
| 5,762,074 | A | 6/1998 | Gamer | |
| 5,782,246 | A | 7/1998 | Axelrod | |
| 5,927,488 | A | 7/1999 | Gray | |
| 6,000,404 | A | 12/1999 | Case et al. | |
| 6,164,443 | A | 12/2000 | Mitchell et al. | |
| 6,321,755 | B1 | 11/2001 | Sinclair, Jr. | |
| 6,357,448 | B1 | 3/2002 | Sinclair, Jr. | |
| 6,526,986 | B1 | 3/2003 | Sinclair, Jr. | |
| 6,571,803 | B1 | 6/2003 | Bregard | |
| 6,638,613 | B1 | 10/2003 | Bland | |
| 6,742,525 | B2 | 6/2004 | Sinclair, Jr. | |
| 6,854,471 | B1 | 2/2005 | Sinclair, Jr. | |
| D526,086 | S | 8/2006 | Mehta | |
| 7,172,672 | B2 | 2/2007 | Silverbrook | |
| 7,717,119 | B1 | 5/2010 | Sinclair, Jr. | |
| 2002/0083952 | A1 | 7/2002 | Braun | |
| 2005/0072437 | A1 | 4/2005 | Gomez | |
| 2005/0072439 | A1 | 4/2005 | Darwish | |
| 2006/0000481 | A1 | 1/2006 | Sinclair, Jr. | |
| 2006/0037622 | A1* | 2/2006 | Bachmann | A24C 5/46 131/347 |
| 2006/0083886 | A1 | 4/2006 | Harrison et al. | |
| 2007/0095359 | A1* | 5/2007 | Kang | A24C 1/00 131/365 |

FOREIGN PATENT DOCUMENTS

| | | |
|---|---|---|
| DE | 202004007772 | 10/2004 |
| EP | 0934703 | 8/1999 |
| GB | 2336989 | 11/1999 |
| WO | WO97/25886 | 7/1997 |
| WO | WO98/20757 | 5/1998 |
| WO | WO03/020057 | 3/2003 |
| WO | WO2006022752 | 3/2006 |
| WO | WO2012064735 | 5/2012 |

* cited by examiner

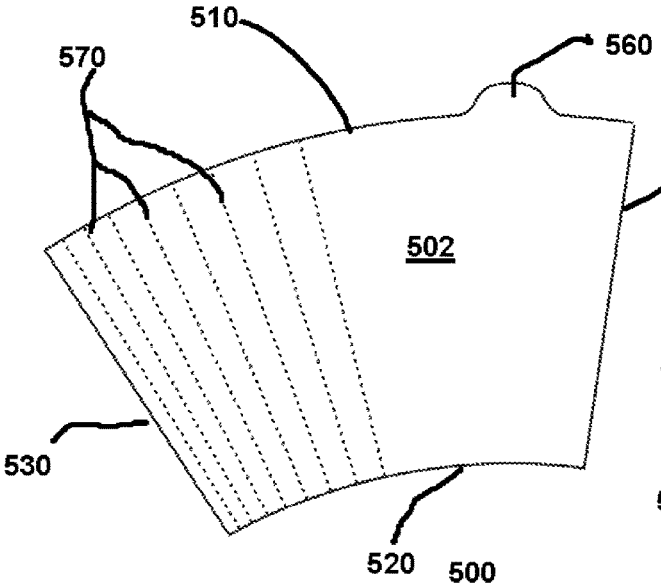
FIG. 7
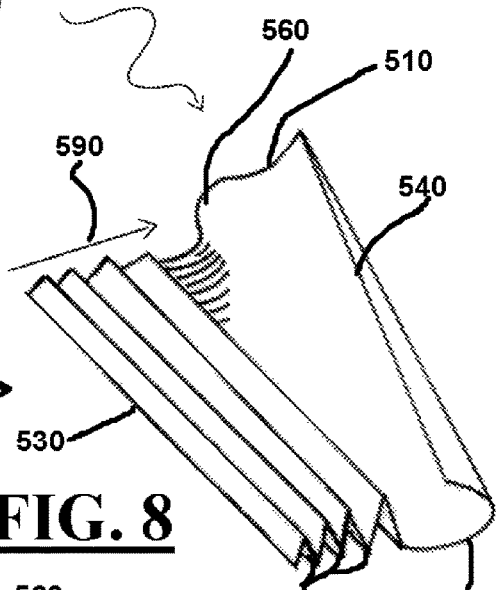
FIG. 8
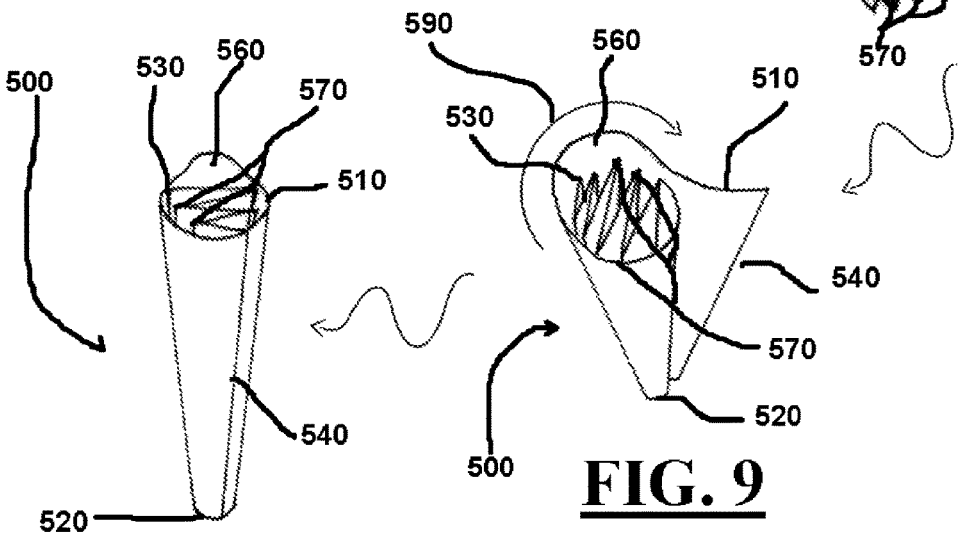
FIG. 9
FIG. 10

1530
1530
1530
200,1500
200
1430
1430
1420
100
100,1400
200,1500
220
180
100
220
180
1500
1500
200
1520
1520
200
280
280
220
220
1500
1520
1104
1430
1100
1420
100
100,1400
1420
180
120
180
120

NESTED PACKAGED CONES WITH SUPPORTING SHAPE INSERTS PACKAGED IN A POUCH

CROSS-REFERENCE TO RELATED APPLICATIONS

This application claims benefit of U.S. Application Ser. No. 62/128,576 filed 5 Mar. 2015, which is hereby incorporated herein by reference and priority is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The present invention relates to smoking articles such as cigars. More particularly, the present invention relates to an improved cigar, cigar shell and method of making a cigar shell wherein a conically or frustoconically shaped form of a cigar shell with an interior and longitudinal centerline is preserved where the cigar shell is packaged for sale in an unfilled state as a set of plurality of nested cigar shells in flexible packaging such as a foil pouch which cigar shell's conical or frustoconical shape is generally preserved in the packaging using a combination of at least one conical or frustoconically shaped supporting insert, and at least one conically or frustoconically shaped cigar shell, and wherein the at least one supporting insert can also be used to support the conical or frustoconical shaped of the cigar shell during filling, wherein during the filling process the smokable filler both passes through the interior of the support insert, and the support insert is longitudinally relative to the cigar shell in a direction opposite of the direction that the smokable filler passes through the supporting insert.

Many cigar smokers prefer to use their own tobacco product as opposed to purchasing cigars that are already constructed and filled with tobacco. These users of fine, custom tobacco prefer to start with an empty shell which they prefer to purchase and then fill with their own custom tobacco filler material or other smokable material after the shell has been removed from its package.

Patents have issued for cigar products or smokable products that begin with an empty shell that is packaged in an empty or less than filled condition, thus enabling a smoker to later add his or her custom tobacco filler. For example, the Sinclair U.S. Pat. Nos. 6,321,755; 6,357,448; 6,526,986; and 7,717,119, each hereby incorporated herein by reference disclose tobacco shells that are packaged empty of contents so that a user can add his or her custom tobacco or other fill material to the shell after opening the package.

BRIEF SUMMARY OF THE INVENTION

Various embodiments relate generally to products for the consumption smokable substances, and more particularly to a product and method of making thereof for the consumption of tobacco and other smokable substances having a hollow conical or frustoconical shape. A conically or frustoconically shaped form has an outer surface, a large diameter end, a small diameter end, and a cavity that extends to said small diameter end.

Various embodiments related generally to products and methods of making thereof, for consumption of tobacco, herbs and other similar smokable substances.

In one embodiment, both the sheet of smokable material and the form are packaged.

In one embodiment, the form and sheet of material are nested, wherein the sheet large section is wrapped around the form.

One embodiments provides a product that is easy to use and provides for a superior smoke.

The present invention may further comprise
- a container for packaging the hollow cone
- whereby the cone will be protected and not lose its shape.

Additionally, the present invention may further comprise
- an elongated member
- for packing smokable substances
- into the hollow cone.

One embodiment provides for a method of making a custom cigar for the consumption of tobacco and other smokable substances resulting in a product that is easy to construct, fill, and finish, and provides for a consistent quality smoke.

One embodiment provides for a method of making a custom cigar for the consumption of tobacco and other smokable fillers, wherein the number of steps required for the consumer to produce a final customized smokable product is reduced as compared to prior art methods.

In one embodiment is provided a product for smoking tobacco and other smokable substances, comprising:
- a first hollow cone having
- a first hollow cone longitudinal axis,
- a first end
  - defining a larger first cone opening perimeter, and
- a second end
  - defining a smaller first cone opening perimeter,
  - whereby
    - the larger first cone opening perimeter
    - has a diameter greater than
      - the diameter of the smaller first cone opening perimeter,
  - whereby
    - a line orthogonal to and spanning between
      - the larger and smaller first cone opening perimeters
      - has a first conical slope and length; and
- a first cone interior,
- the first cone interior being defined by a space between
  - the larger first cone opening perimeter and
  - the smaller first cone opening perimeter,
- wherein, the first cone is comprised of
- tobacco,
- homogenized tobacco or
- natural leaf material;
- a first support
- being substantially located in the interior of the first hollow cone,
- the first support having
  - a first support longitudinal axis,
  - a larger first support end
    - defining a larger first support opening perimeter, and
  - a smaller first support end
    - defining a smaller first support opening perimeter,
  - whereby
    - the larger first support opening perimeter has a diameter greater than
the diameter of the smaller first support opening perimeter,
whereby
a line spanning between
the first and second first support opening perimeters
has a first support slope;
wherein
the first conical slope is about the same as the first support slope, and
the first support tends to maintain the first hollow cone in a conical shape; and
a second hollow cone
being substantially located in the interiors of both the first support and first hollow cone,
the second hollow cone having
a second hollow cone longitudinal axis,
a first end
defining a larger second cone opening perimeter, and
a second end
defining a smaller second cone opening perimeter,
whereby
the larger second cone opening perimeter
has a diameter greater than
the diameter of the smaller second cone opening perimeter,
whereby
a line orthogonal to and spanning between
the larger and smaller second cone opening perimeters
has a second conical slope and length; and
a second cone interior,
the second cone interior being defined by a space between the larger second cone opening perimeter and the smaller second cone opening perimeter,
wherein, the second cone is comprised of
tobacco,
homogenized tobacco or
natural leaf material;
a second support
being located substantially in the interiors of the second hollow cone, first support, and first hollow cone,
the second support having
a second support longitudinal axis,
a larger second support end
defining a larger second support opening perimeter, and
a smaller second support end
defining a smaller second support opening perimeter,
whereby
the larger second support opening perimeter
has a diameter greater than
the diameter of the smaller second support opening perimeter,
whereby
a line spanning between
the first and second support opening perimeters
has a second support slope;
wherein
the second conical slope is about the same as the second support slope, and
the second support tends to maintain the first and second hollow cones in a conical shape, and
the second support longitudinal axis
is generally parallel with the second hollow cone longitudinal axis,
which is generally parallel with the first support longitudinal axis,
which is generally parallel with the first hollow cone longitudinal axis.

In one embodiment is provided a packaged cigar apparatus that generates two smokable articles, comprising:

a) a package having an interior and an end portion with a sealed opening;
b) first and second shells, each being a hollow, conically shaped smokable shell, each with a shell interior;
c) a first reinforcing cone that is able to occupy a position within the shell interior of the first conically shaped smokable shell, said first reinforcing cone having a stiffness that is greater than the stiffness of the first smokable shell;
d) wherein the first reinforcing cone has an open ended hollow bore;
e) a second reinforcing cone that fits inside the shell interior of the second conically shaped smokable shell, said second reinforcing cone having a stiffness that is greater than the stiffness of said second smokable shell;
f) said second reinforcing cone having a one or more of transversely positioned panels; and
g) wherein the shells and reinforcing cones are packaged inside the package interior as an assembly wherein the first reinforcing cone occupies the shell interior of the first shell and the second reinforcing cone occupies the shell interior of the second shell.

In one embodiment is provided a packaged cigar apparatus that generates two smokable articles, comprising:

a) a package having an interior and an end portion with a sealed opening;
b) first and second shells, each being a hollow conically shaped smokable shell, each with a shell interior;
c) a reinforcing cone that is able to occupy a position within the shell interior of the first conically shaped smokable shell, said reinforcing cone having a stiffness that is greater than the stiffness of the first smokable shell;
d) wherein the reinforcing cone has a hollow cone shaped cone interior;
e) the reinforcing cone having an upper end portion with a tab;
f) a push rod for enabling a user to compress tobacco that is placed within said first or said second shell; and
g) wherein the shells, reinforcing cone, and push rod are packaged inside the package interior as an assembly wherein the reinforcing cone occupies the shell interior of the first In one embodiment is provided a method of constructing a pair of packaged cigars, comprising the steps of:
a) providing a package having an interior and an end portion with a sealed opening;
b) providing first and second shells, each being a hollow, conically shaped smokable shell with a shell interior;
c) placing a reinforcing cone within the shell interior of the first conically shaped smokable shell, said cone having a lower opening;
d) placing a push rod in said package;
e) packaging the shells and reinforcing cone inside the package as an assembly wherein the reinforcing cone occupies the shell interior of the first shell;
f) enabling the construction of two cigars by a removal of the shells, reinforcing cone and push rod from the package so that a user can fill each shell with his or her selected smokable material, using the push rod to compact smokable material that is placed within a said shell; and g) wherein the reinforcing cone is configured to support the shell during step "f", while simultaneously allowing smokable material to travel from the cone to the shell via the lower opening.

In one embodiment during steps "d" through "f" the push rod occupies a position inside the second shell.

In one embodiment the push rod has a rigidity that is greater than the rigidity of the second shell.

In one embodiment the push rod is cone shaped.

In one embodiment, the push rod nests inside the second shell.

In one embodiment of the method during n step "c" the reinforcing cone has a tab that can be gripped by a user, and further comprising separating the cone from the first shell during steps "f" and "g" by pulling on the tab.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 7 is a top view of the inner support shown flat.

FIG. 8 is a perspective view of the inner support shown partially folded and rolled.

FIG. 9 is a perspective view of the inner support shown fully folded and partially rolled.

FIG. 10 is a perspective view of the inner support shown fully rolled.

DETAILED DESCRIPTION OF THE INVENTION

Figure 1:
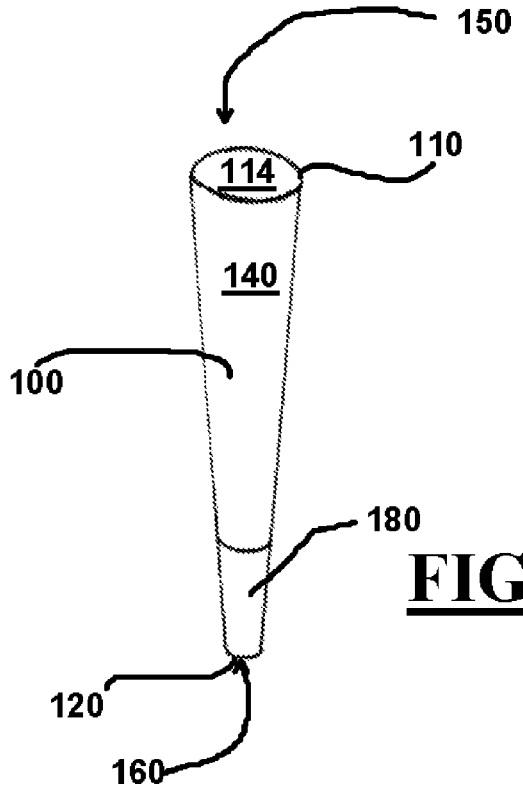
FIG. 1 is a perspective view of the first cone by itself.

Smokable article kit includes first 100 and second 200 cones with outer 400 and inner 500 support which are packaged for sale in a flexible packaging 800 (such as a foil pouch) when not filled with smokable filler material.

Package or flexible wrapper 800 can be flexible and any shape such as rectangular. The package 800 has interior 830 that can be closed. The interior 830 can be sized and shaped to contain the combination of cigar cones 100,200, etc. and supporting supports 400,500, etc. The package or wrapper 830 has closed end 810 and open end 820 that would enable insertion of the combination of cones 100,200 and supporting inserts 400,500 into the interior 830. A seal 840 could be formed at in order to encapsulate the combination cones 100,200 and supporting inserts 400,500 into the interior 830.

Supporting inserts 400, 500 can be used to prevent compression the flexible cones 100, 200 when packaged, and can further be used to compress or tamp custom smokable filler material once added to first 100 or second 200 cones. A user then closes the cone 100,200 at twisted portion or closed end which is opposite filter element 180,280. The user then lights the closed end or twisted end in order to smoke the article.

Supporting inserts 500 can be formed from one or more sheets. Sheets can have first section which can be rectangular and joined to second section which can be rectangular. The second section can be folded or formed into corrugations. The corrugations can include peaks and valleys or ridges and troughs as shown in figures.

The combination of support inserts 400,500 and cones 100,200 or shells can be packaged by insertion into interior of package or wrapper 800. The package or wrapper 800 has a closed end portion 810 and an open end portion 820. The supporting inserts 400,500 and cones 100,200 or shells are shown in the figures in the nested configuration. A seal 840 would then be formed at open end 820. The package or wrapper 800 can be of flexible plastic material.

In various embodiments the apparatus of the present invention enables a user or smoker to support his or her custom smokable filler into hollow interior of cones or shells 100,200 after they have been removed from package or wrapper 800 and separated from each other. The larger section of each cone 100,200 has a frustoconical shape with an opening into which custom smokable filler material can be added.

A user 5 can use second cone 200 with inner support 500 to tamp or compress the smokable material within larger section of cone or shell 100. In such a situation, the filter 180 of the first cone 100 prevents the tamped smokable filler material added from exiting the interior 114 of cone or shell 100. The open end 150 of cone or shell 100 can be wrapped or twisted until it is closed to form a closure.

The finished article can be smoked by placing the filter end in the user's mouth and by lighting the closure.

FIG. 1 is a perspective view of the first cone 100 by itself which can be constructed by conventional methods. First cone 100 can include first end 110, second end 120, outer surface 140, and filter tip 180. At first end 110 can be first opening 150. At second end 120 can be second opening 160. First opening 150 can be larger than second opening 160 giving first cone 100 its conical shape. Between first end 110 and second end 120 is interior portion 114 which includes inner surface 130.

Figure 2:
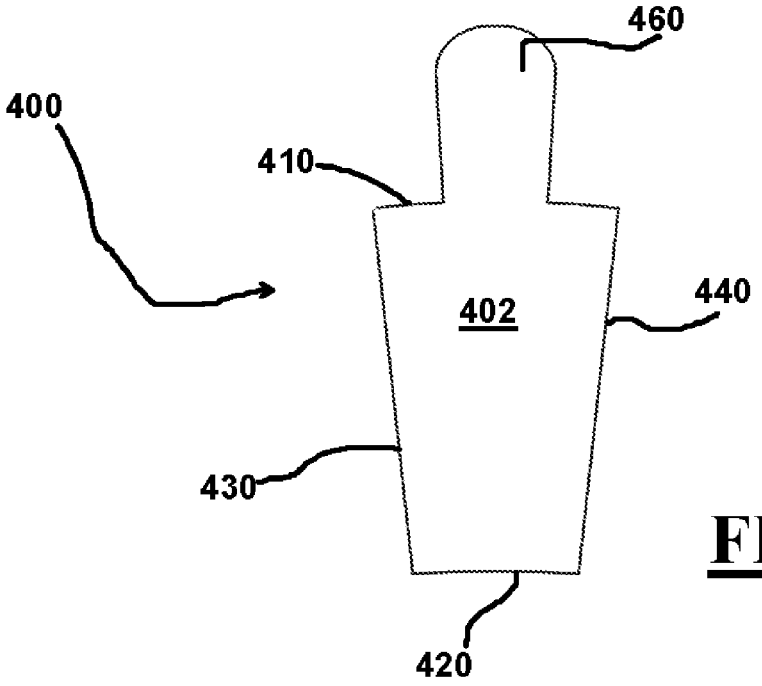
FIG. 2 is a top view of the outer support shown flat.
Figure 3:
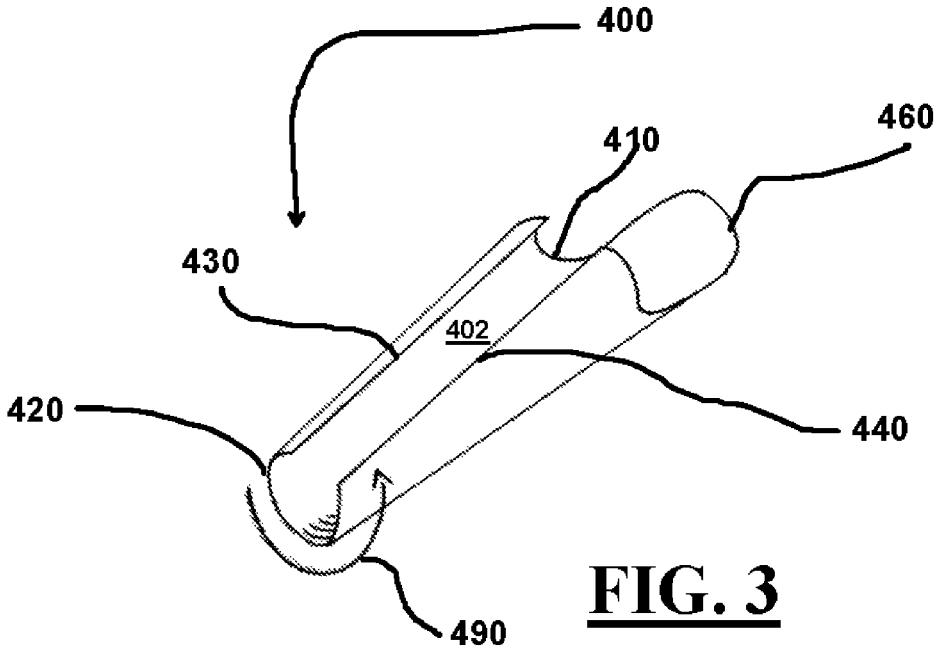
FIG. 3 is a perspective view of the outer support shown partially rolled.
Figure 4:
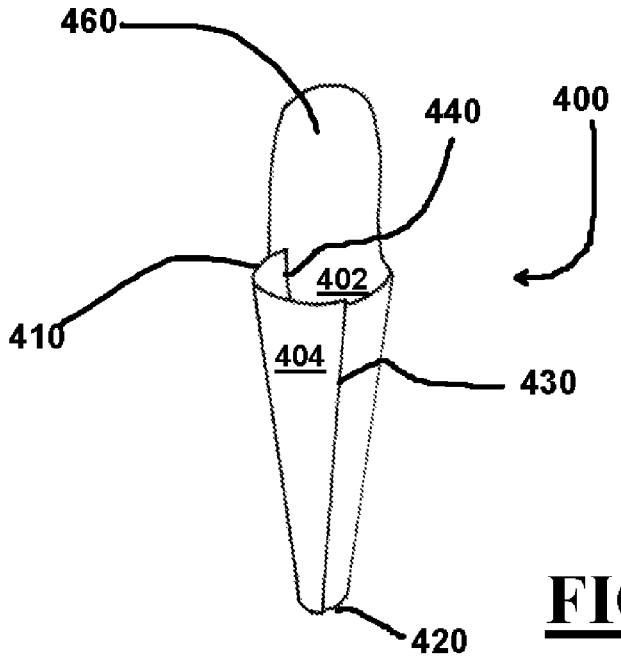
FIG. 4 is a perspective view of the outer support shown fully rolled.

FIG. 2 is atop view of the outer support 400 shown flat. When flat, outer support 400 can include first end 410, second end 420, first edge 430, second edge 440, first side 402, second side 404, and tab 460. Outer support 400 can be constructed by rolling its flat sheet form into a hollow cone shape. FIG. 3 is a perspective view of the outer support 400 shown partially rolled. FIG. 4 is a perspective view of the outer support 400 shown fully rolled with first edge being glued onto second side 404, and second edge 440 being glued onto first side 402 such that outer support maintains a hollow conical form. At first end 410 can be first opening 412. At second end 420 can be second opening 422. First opening 412 can be larger than second opening 422 giving outer support 400 its conical shape. Tab or lip 460 extends from first end 410 and includes a concave surface. Between first end 410 and second end 420 is interior portion 414 which includes inner surface 415.

Figure 5:
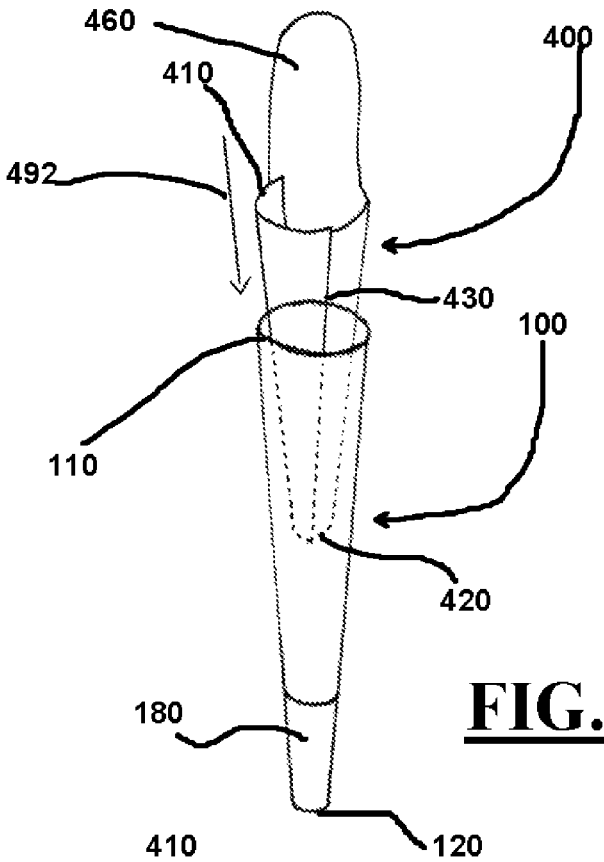
FIG. 5 is a perspective view of the outer support partially inserted into the first cone.
Figure 6:
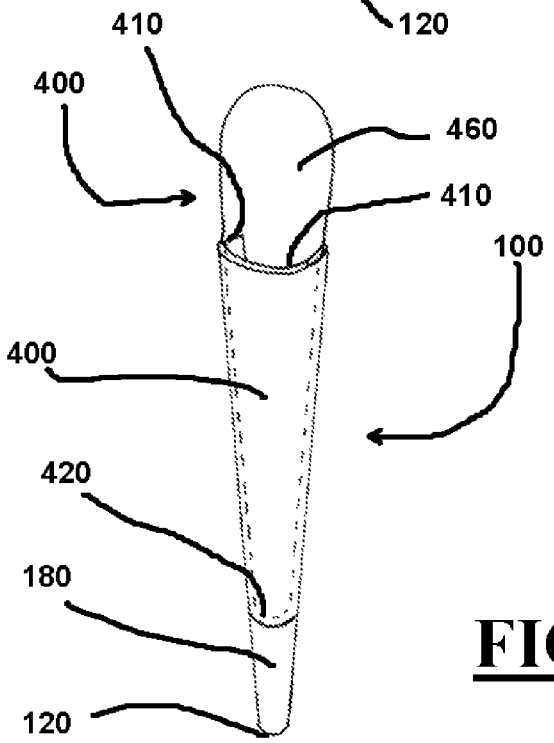
FIG. 6 is a perspective view of the outer support shown fully inserted into the first cone.

Outer support 400 can be used to maintain the conical shape of first and second cones 100,200 which are comprised of at least one sheet of smokable material that is flexible and bendable. FIG. 5 is a perspective view of the outer support 400 shown fully rolled and partially inserted into the first cone 100. FIG. 6 is a perspective view of the outer support 400 shown fully inserted into the first cone 100.

FIG. 7 is atop view of the inner support 500 shown flat. When flat, inner support 500 can include first end 510, second end 520, first edge 530, second edge 540, first side 502, second side 504, tab 560, and a plurality of fold lines which can be perforated, lined, etched or merely folded. Inner support 500 can be constructed by both folding a first portion (from first edge 530 to the plurality of fold lines 570) and rolling a portion of its flat sheet form (from second edge 540) into a hollow cone shape. FIG. 8 is a perspective view of the inner support 500 shown partially folded and rolled. FIG. 9 is a perspective view of the inner support 500 shown fully folded and partially rolled. FIG. 10 is a perspective view of the inner support 500 shown fully rolled. with first edge being glued onto second side 504, and second edge 540 being glued onto first side 502 such that inner support 500 maintains a hollow conical form. At first end 510 can be first opening 512. At second end 520 can be second opening 522. First opening 512 can be larger than second opening 522 giving inner support 500 its conical shape. Tab or lip 560 extends from first end 510 and includes a concave surface. Between first end 510 and second end 520 is interior portion 514 which includes the plurality of folds 570, which plurality of folds resist flattening of the conical shape of inner support 500.

Figure 11:
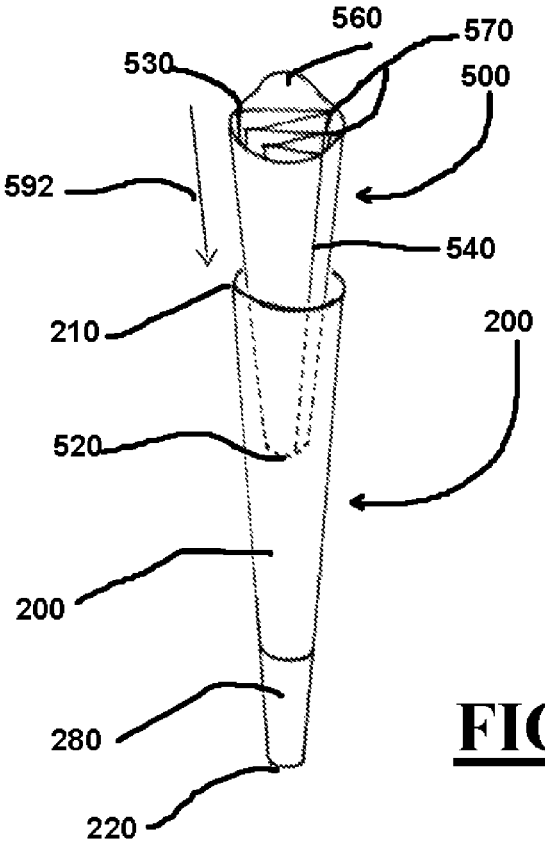
FIG. 11 is a perspective view of the inner support shown partially inserted into the second cone.
Figure 12:
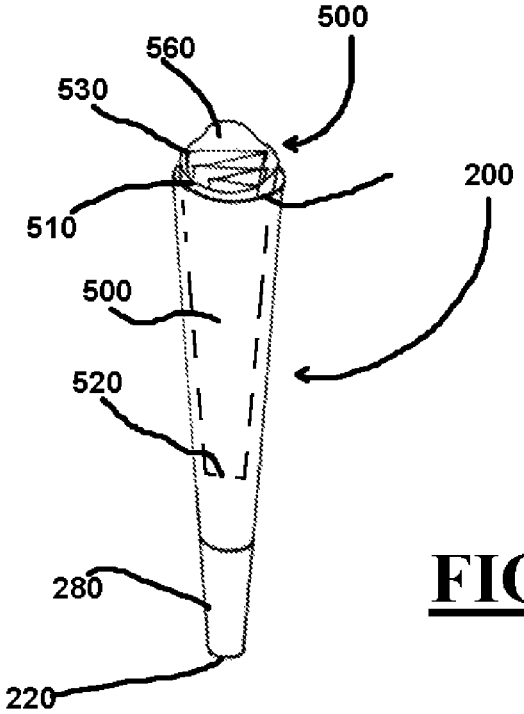
FIG. 12 is a perspective view of the inner support shown fully inserted into the second cone.

FIG. 11 is a perspective view of the inner support 500 shown fully rolled and partially inserted into the second cone 200. Second cone 200 can be substantially the same as first cone 100. Second cone 200 can include first end 210, second end 220, outer surface 240, and filter tip 280. At first end 210 can be first opening 250. At second end 220 can be second opening 260. First opening 250 can be larger than second opening 260 giving second cone 200 its conical shape. Between first end 210 and second end 220 is interior portion 214 which includes inner surface 230. FIG. 12 is a perspective view of the inner support 500 shown fully inserted into the second cone 200.

Figures 13, 14, 15:
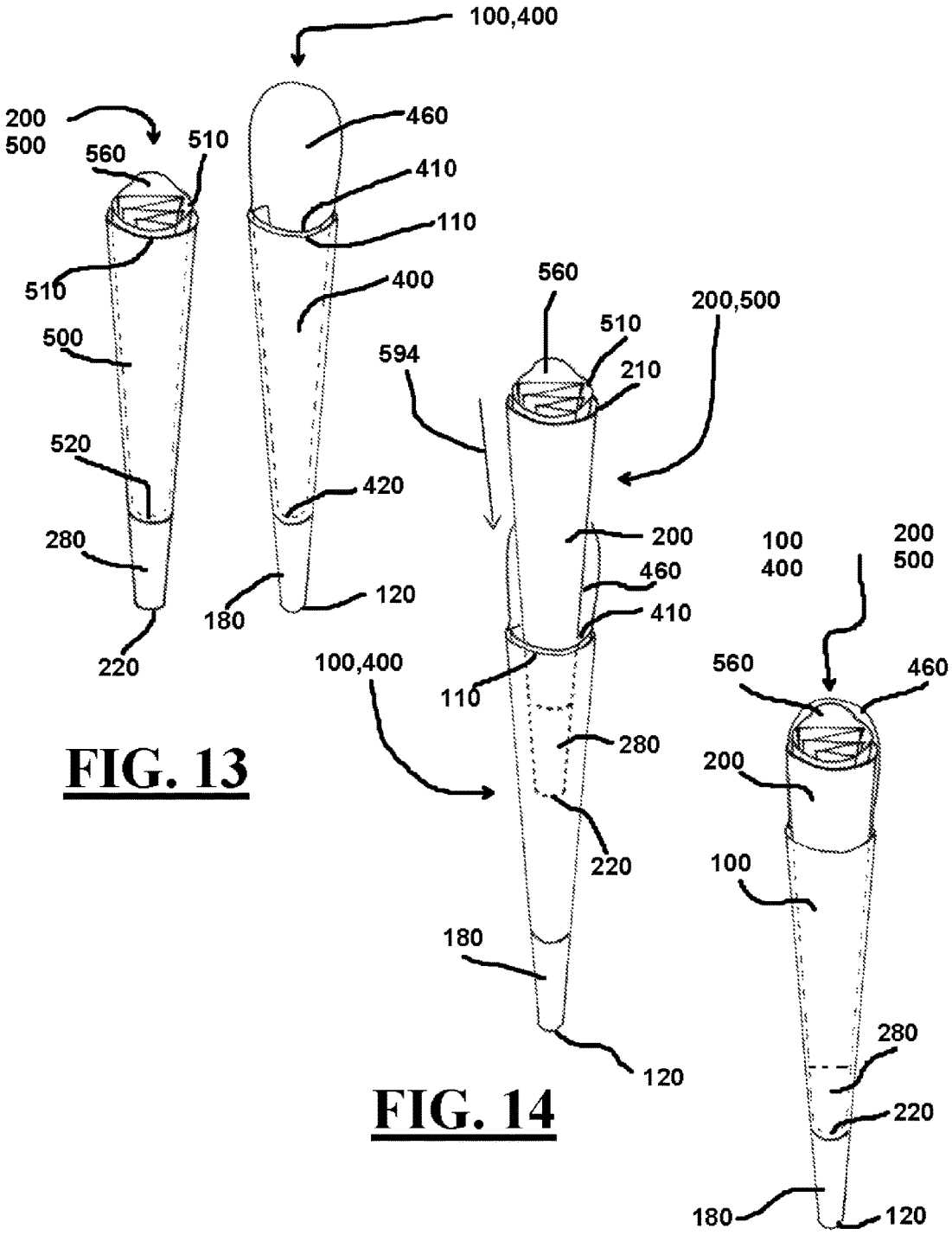
FIG. 13 is a perspective view of the first and second cones shown side by side with respective outer and inner supports.
FIG. 14 is a perspective view of the second cone with inserted inner support being partially inserted into the second cone with inserted outer support.
FIG. 15 is a perspective view of the second cone (with inserted inner support) now fully inserted into the first cone (with inserted outer support).

FIG. 13 is a perspective view of the first 100 and second 200 constructed cones shown side by side with respective outer 400 and inner supports 500. FIG. 14 is a perspective view of the second cone 200 with inserted inner support 500 being partially inserted into the second cone 100 with inserted outer support 400. FIG. 15 is a perspective view of the second cone 200 (with inserted inner support 500) now fully inserted into the first cone 100 (with inserted outer support 400). In this configuration, inner support 500 supports the conical shape of both first 100 and second 200 cones. Outer support 400 supports the conical shape of both first 100 and second 200 cones.

Figure 16:
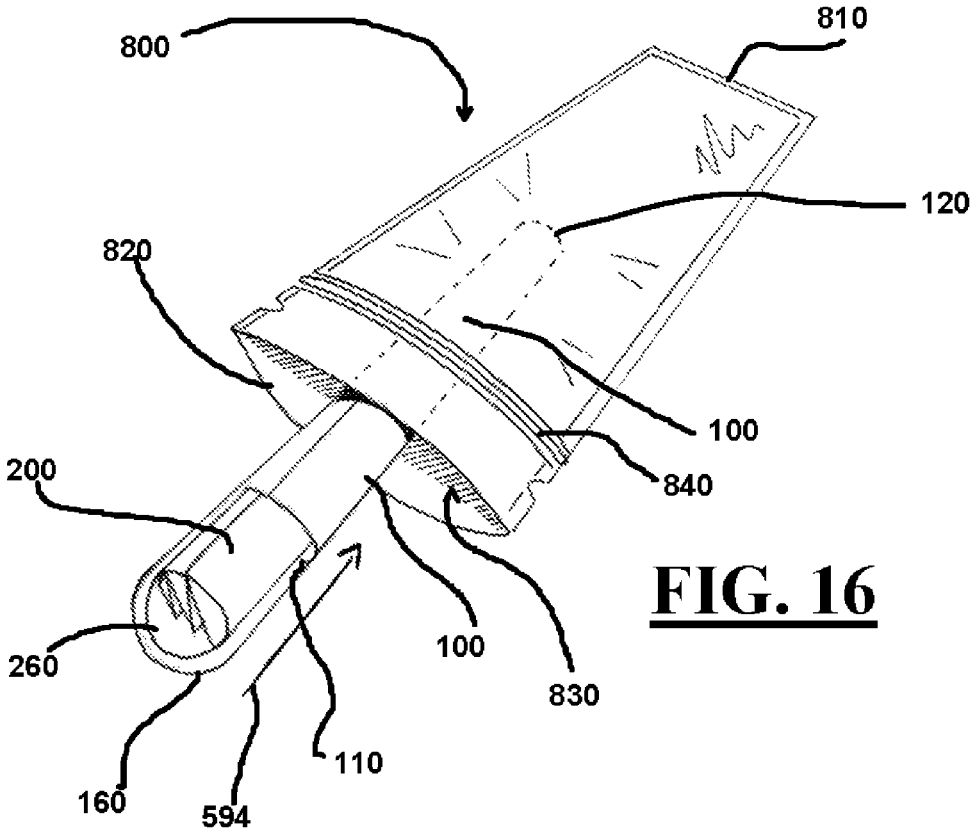
FIG. 16 is a perspective view of the first and second cones being partially inserted into a sealable packing pouch.
Figure 17:
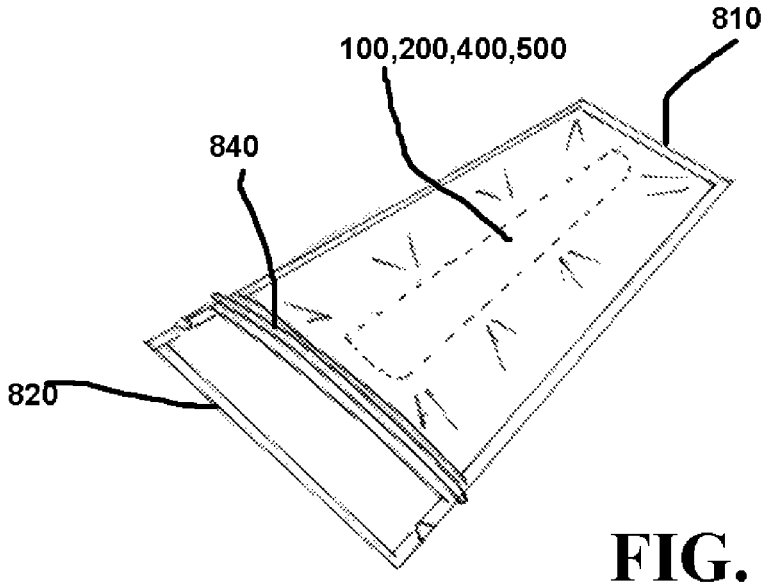
FIG. 17 is a perspective view of the first and second cones fully inserted into the packaging pouch (show in dashed lines) which packaging pouch is now sealed.

The support of outer 400 and inner 500 supports resists the flattening out of the conical shape of first 100 and second 200 cones when these cones are packaged in a flexible packaging 800. FIG. 16 is a perspective view of the first 100 and second 200 cones being partially inserted into a sealable packing pouch 800 (schematically indicated by arrow 594). FIG. 17 is a perspective view of the first 100 and second 200 cones fully inserted into the packaging pouch 800 (show in dashed lines) which packaging pouch 800 is now sealed.

Packaging pouch 800 with first 100 and second 200 cones nested with outer 400 and inner 500 supports can be offered for sale, such as in retail outlets to consumers who desire to make customized smokable products. The customer would purchase pouch 800 with first 100 and second 200 cones and then use the first 100 and second 200 cones along with outer 400 and inner 500 supports to make a one or more customized cigars.

Figure 18:
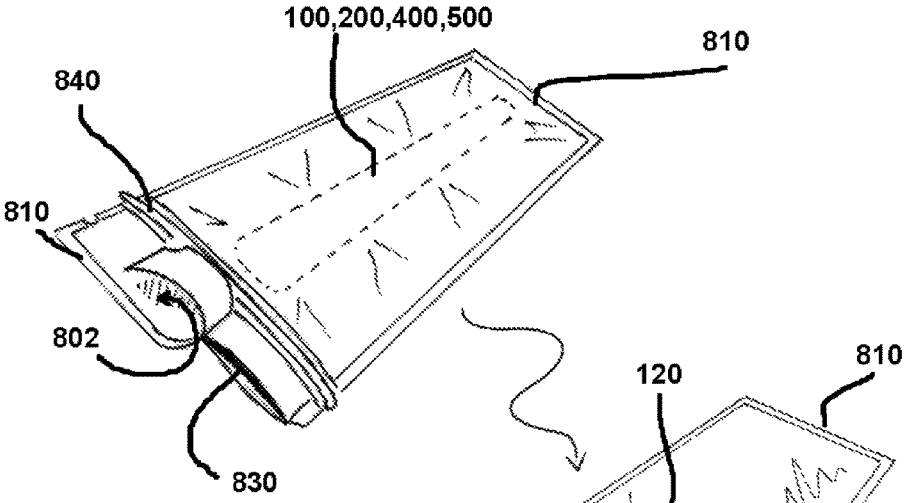
FIG. 18 is a perspective view of the packaging pouch of FIG. 17 now being opened.
Figure 19:
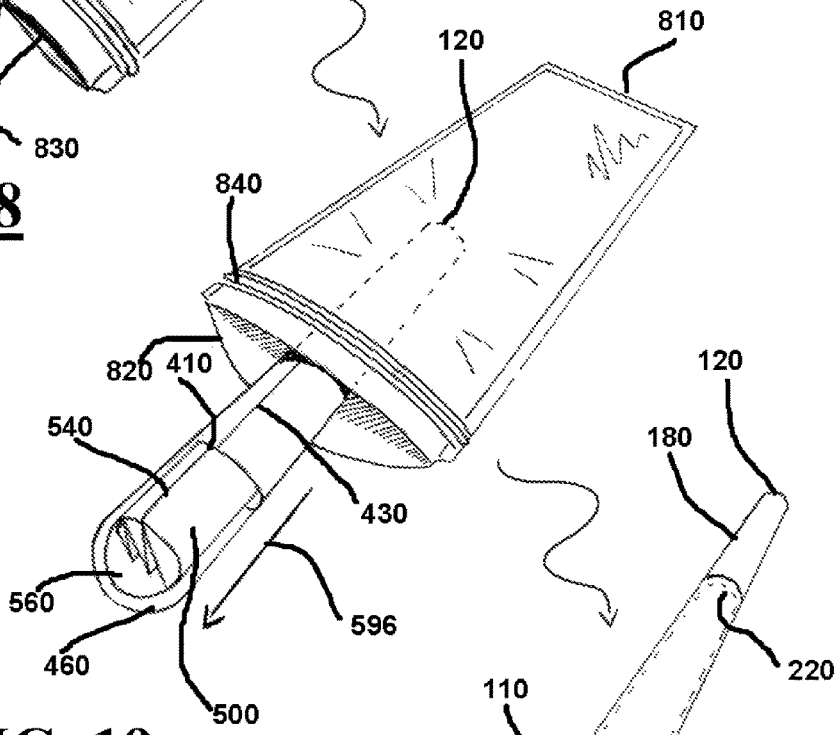
FIG. 19 is a perspective view of the first and second cones being partially removed from the opened packaging pouch of FIG. 19.
Figure 20:
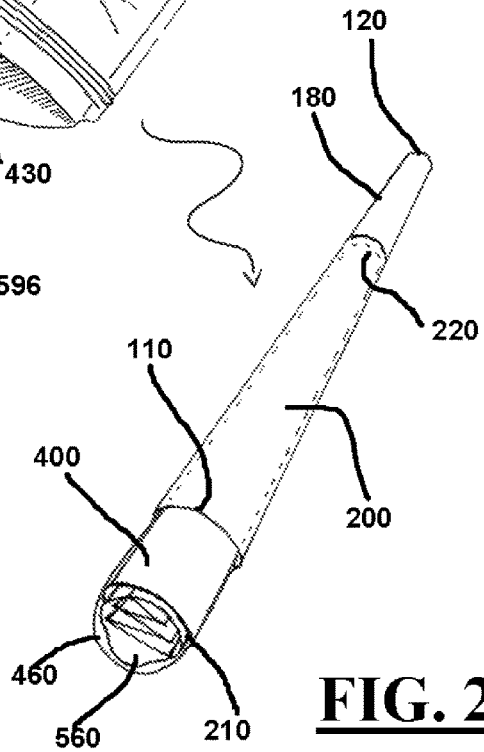
FIGS. 20 and 21 are perspective views of the now removed first and second cones.
Figures 21, 22, 23, 24, 25:
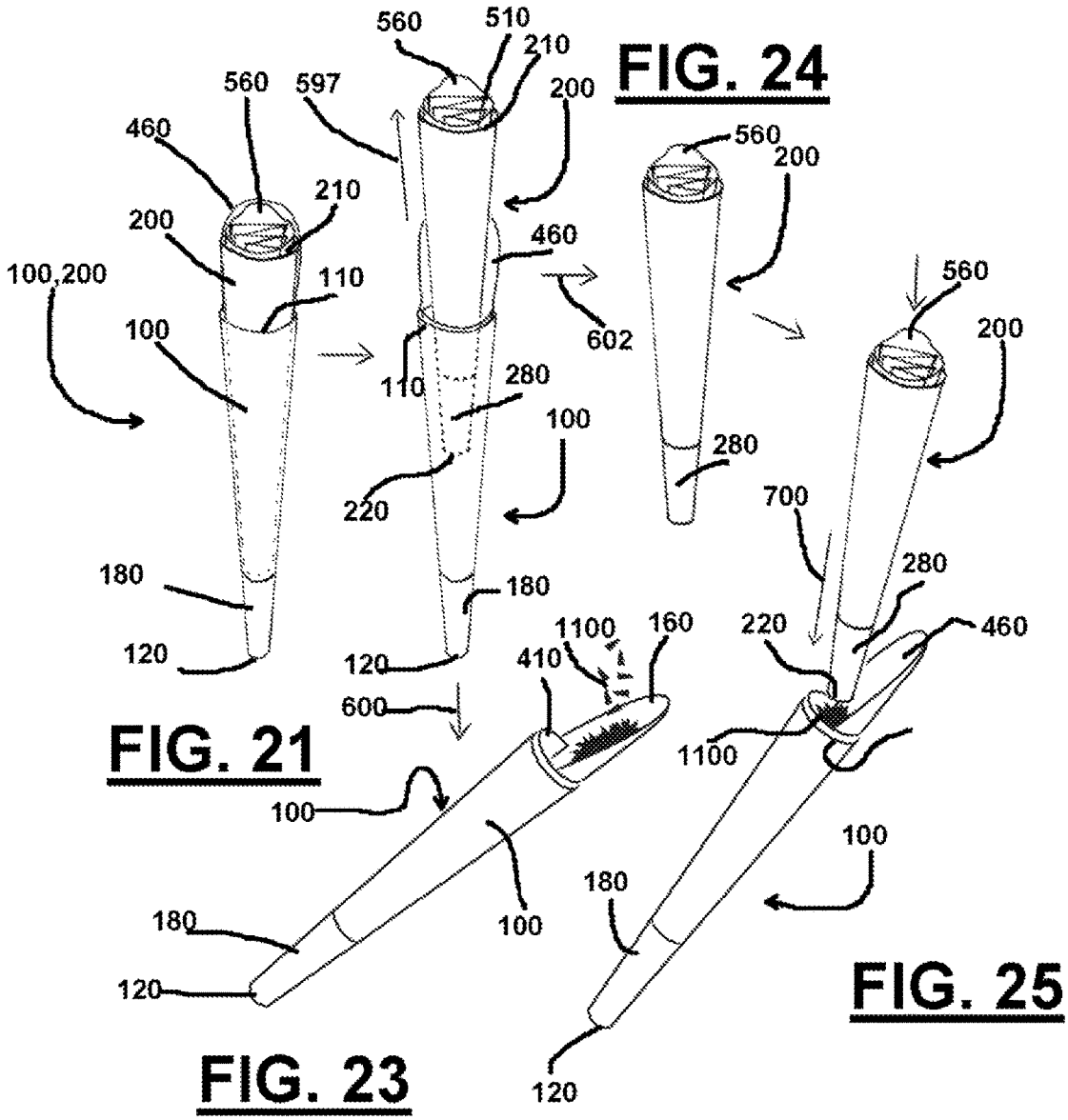
FIG. 22 is a perspective view of the second cone with inner support being partially removed from the first cone with outer support.
FIG. 23 is a perspective view of the first cone with outer support being filled with smokable filler.
FIG. 24 is a perspective view of the second cone with inner support (now removed from the first cone with outer support).
FIG. 25 is a perspective view of the second cone (with inner support) being used as a tamping device to stuff or tamp down the smokable filler added to the first cone with outer support shown in FIG. 23.

FIG. 18 is a perspective view of the packaging 800 now being opened (schematically indicated by arrow 802). FIG. 19 is a perspective view of the first 100 and second 200 cones being partially removed from the opened packaging pouch 800 (schematically indicated by arrow 596). FIGS. 20 and 21 are perspective views of the now removed first 100 and second 200 cones.

One embodiment of the steps for creating a customized smokable product with the first 100 and second 200 cones with outer 400 and inner 500 supports will now be described.

FIG. 22 is a perspective view of the second cone 200 with inner support 500 being partially removed from the first cone 100 with outer support 400 (schematically indicated by arrow 597). FIG. 23 is a perspective view of the first cone 100 with outer support 400 being filled with smokable filler 1100. Such smokable filler 1100 will slide down the interior 414 of outer support 400 towards second end 420. However, at least some of the filler is expected to be partially blocked at second end 420 and must be tamped through. For this operation second cone 200 with inner support 500 can serve as a useful tamping device. FIG. 24 is a perspective view of the second cone 200 with inner support 500 now removed from the first cone 100 with outer support 400.

Figures 26, 27, 28, 29, 30:
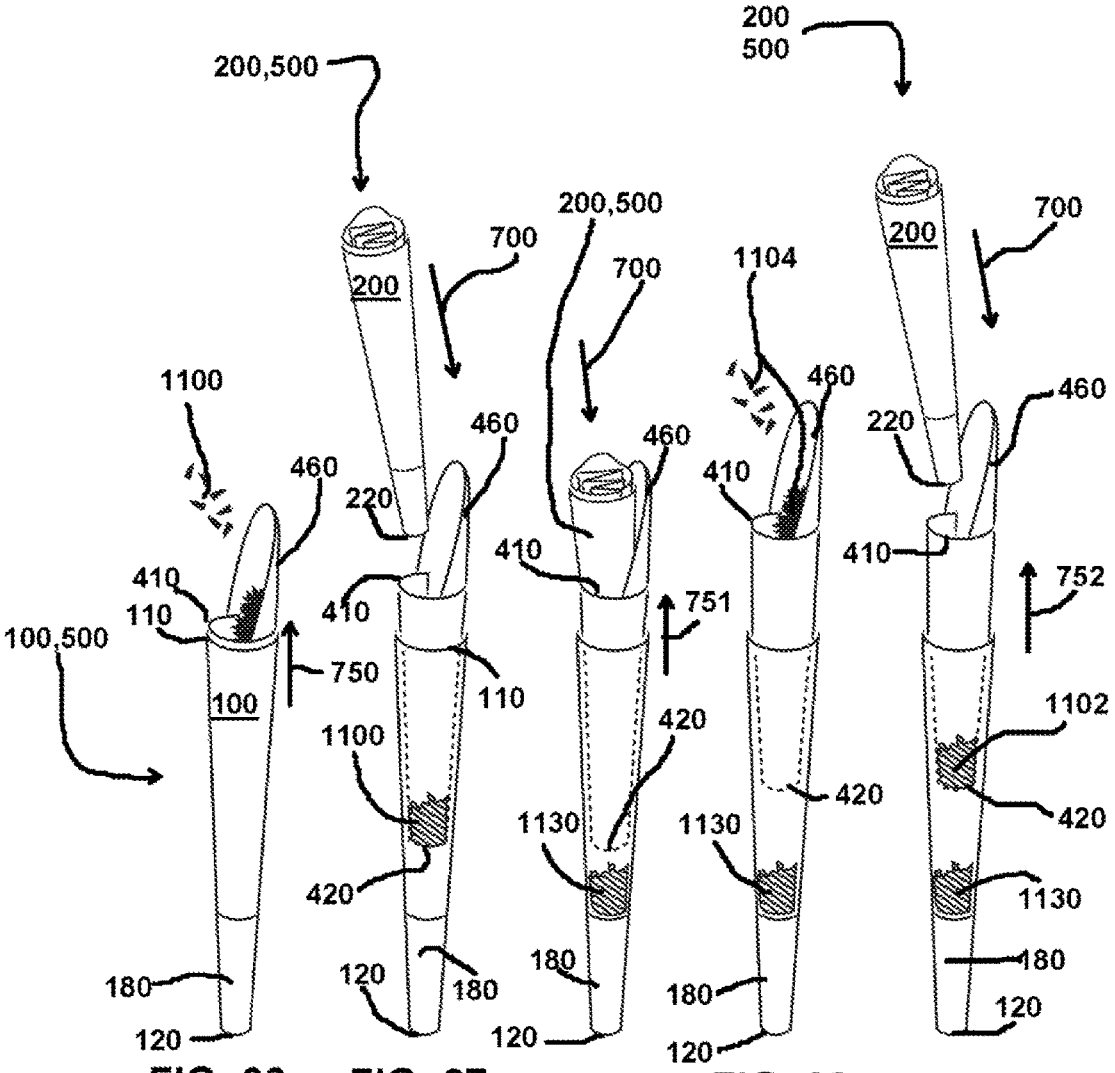
FIG. 26 is another perspective view of the first cone with outer support being filled with smokable filler of FIG. 23, and schematically indicating that the outer support will be pulled up longitudinally relative to the first cone during the filling and tamping process.
FIG. 27 is a perspective view of the first cone with outer support, wherein outer support has been pulled up longitudinally up relative to the first cone, the smokable filler added in FIG. 26 is at the lower end of the outer support, and the second cone with inner support is being used to tamp said smokable filler through the lower end of the outer support and into the interior of the first cone.
FIG. 28 is a perspective view of the first cone with outer support, wherein second cone with inner support has successfully tamped the smokable filler through the lower end of the outer support, showing this tamped filler at the bottom of the interior of the first cone, causing the first cone to be partially filled with smokable filler material, and also showing the outer support being additionally pulled up longitudinally relative to the first cone to allow the continuation of the tamping and filling process.
FIG. 29 is perspective view of the first cone with outer support being filled with more smokable filler (compared to FIG. 26), and showing the previously tamped smokable filler (from FIG. 28) in the interior of the first cone.
FIG. 30 is a perspective view of the first cone with outer support, wherein outer support has been pulled longitudinally up relative to the first cone, the smokable filler added in FIG. 29 is at the lower end of the outer support, and the second cone with inner support is being used to tamp said smokable filler through the lower end of the outer support and into the interior of the first cone (to be combined with the previously tamped smokable filler from FIG. 28).

FIG. 25 is a perspective view of the second cone 200 with inner support 500 being used as a tamping device to stuff or tamp (schematically indicated by arrow 700) down the smokable filler 1100 added to the first cone 100 with outer support 400. FIG. 26 is another perspective view of the first cone 100 with outer support 400 being filled with smokable filler 1100, and schematically indicating (arrow 750) that the outer support 400 will be pulled up longitudinally relative to the first cone 100 during the filling and tamping process. The pulling up in the direction of arrow 750 of outer support 400 allows for tamped smokable filler to accumulate in the interior 114 of first cone 100. On the other hand, if outer support was filled with smokable filler and merely pulled out of first cone 100 it is expected that the smokable filler would also be pulled out of first cone 100 when outer support 400 is pulled out.

Figures 31, 32, 33, 34:
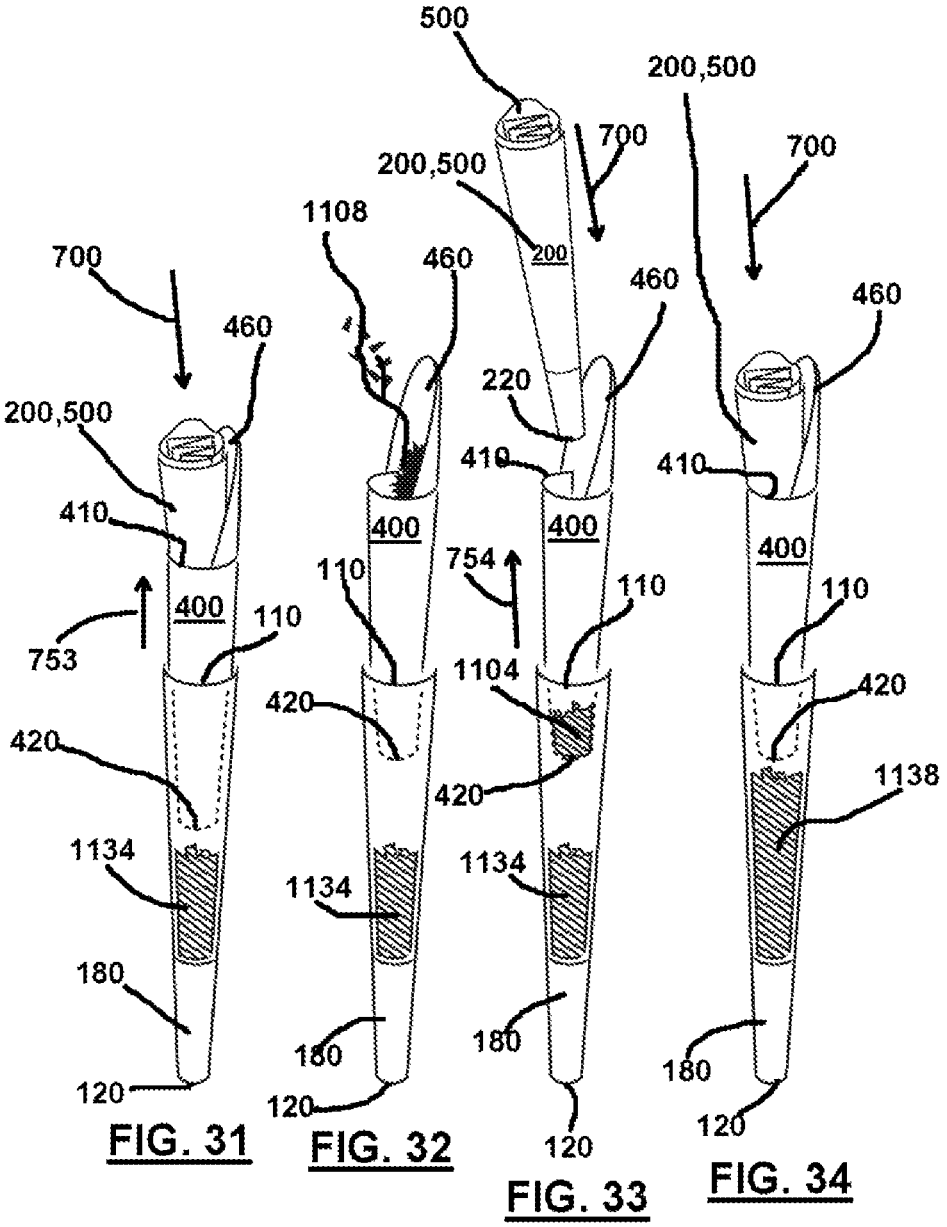
FIG. 31 is a perspective view of the first cone with outer support, wherein second cone with inner support has successfully tamped the smokable filler added in FIG. 30 through the lower end of the outer support which has now combined in the interior of the second cone with the previously tamped smokable filler (from FIG. 28), and also showing the outer support being additionally pulled up longitudinally relative to the first cone to allow the continuation of the tamping and filling process.
FIG. 32 is perspective view of the first cone with outer support being filled with even more smokable filler (compared to FIG. 29), and showing the previously tamped smokable filler (from FIG. 31) in the interior of the first cone.
FIG. 33 is a perspective view of the first cone with outer support, wherein outer support has been pulled longitudinally up relative to the first cone, the smokable filler added in FIG. 32 is at the lower end of the outer support, and the second cone with inner support is being used to tamp said smokable filler through the lower end of the outer support and into the interior of the first cone (to be combined with the previously tamped smokable filler from FIG. 33).
FIG. 34 is a perspective view of the first cone with outer support, wherein second cone with inner support has successfully tamped the smokable filler added in FIG. 32 through the lower end of the outer support which has now combined in the interior of the first cone with the previously tamped smokable filler (from FIG. 33).

The tamping process and partially pulling up outer support 400 relative to first cone can be continued. FIG. 27 is a perspective view of the first cone 100 with outer support 400, wherein outer support 400 has been pulled longitudinally up relative to the first cone 100, the smokable filler 1100 added is at the lower end 420 of the outer support 400, and the second cone 200 with inner support 500 is being used to tamp (schematically indicated by arrow 700) said smokable filler 1100 through the lower end 420 and into the interior 114 of the first cone 100. FIG. 28 is a perspective view of the first cone 100 with outer support 400, wherein second cone 200 with inner support 500 has successfully tamped the smokable filler 1100 through the lower end 420 of the outer support 400, showing this tamped filler 1130 at the bottom of the first cone 100, causing the first cone 100 to be partially filled with smokable filler material 1130, and also showing the outer support 400 being additionally pulled up longitudinally (schematically indicated by arrow 751) relative to the first cone 100 to allow the continuation of the tamping and filling process. FIG. 29 is perspective view of the first cone 100 with outer support 400 being filled with more smokable filler 1104, and showing the previously tamped smokable filler 1130 in the interior 114 of the first cone 100. FIG. 30 is a perspective view of the first cone 100 with outer support 400, wherein outer support 400 has been pulled longitudinally up (schematically indicated by arrow 752) relative to the first cone 100, the smokable filler 1104 is at the lower end 420 of the outer support 400, and the second cone 200 with inner support 500 is being used to tamp said smokable filler 1104 through the lower end 420 of the outer support 400 and into the interior 114 of the first cone 100 (to be combined with the previously tamped smokable filler 1130. FIG. 31 is a perspective view of the first cone 100 with outer support 400, wherein second cone 200 with inner support 500 has successfully tamped the smokable filler 1104 through the lower end 420 of the outer support 400 (shown as smokable filler 1134) which has now combined in the interior 114 of the first cone 100 with the previously tamped smokable filler 1130, and also showing the outer support 400 being additionally pulled up longitudinally (schematically indicated by arrow 753) relative to the first cone 100 to allow the continuation of the tamping and filling process. FIG. 32 is perspective view of the first cone 100 with outer support 400 being filled with even more smokable filler 1108, and showing the previously tamped smokable filler 1132 in the interior 114 of the first cone 100. FIG. 33 is a perspective view of the first cone 100 with outer support 400, wherein outer support 400 has been pulled longitudinally up (schematically indicated by arrow 754) relative to the first cone 100, the smokable filler 1108 is at the lower end 420 of the outer support 400, and the second cone 200 with inner support 500 is being used to tamp said smokable filler 1108 through the lower end 420 and into the interior 114 of the first cone 100 (to be combined with the previously tamped smokable filler 1134). FIG. 34 is a perspective view of the first cone 100 with outer support 400, wherein second cone 200 with inner support 500 has successfully tamped the smokable filler 1108 through the lower end 420 of the outer support 400 which has now combined in the interior 114 of the first cone (shown as filler 1138) with the previously tamped smokable filler 1134.

Figures 35, 36, 37, 38, 39:
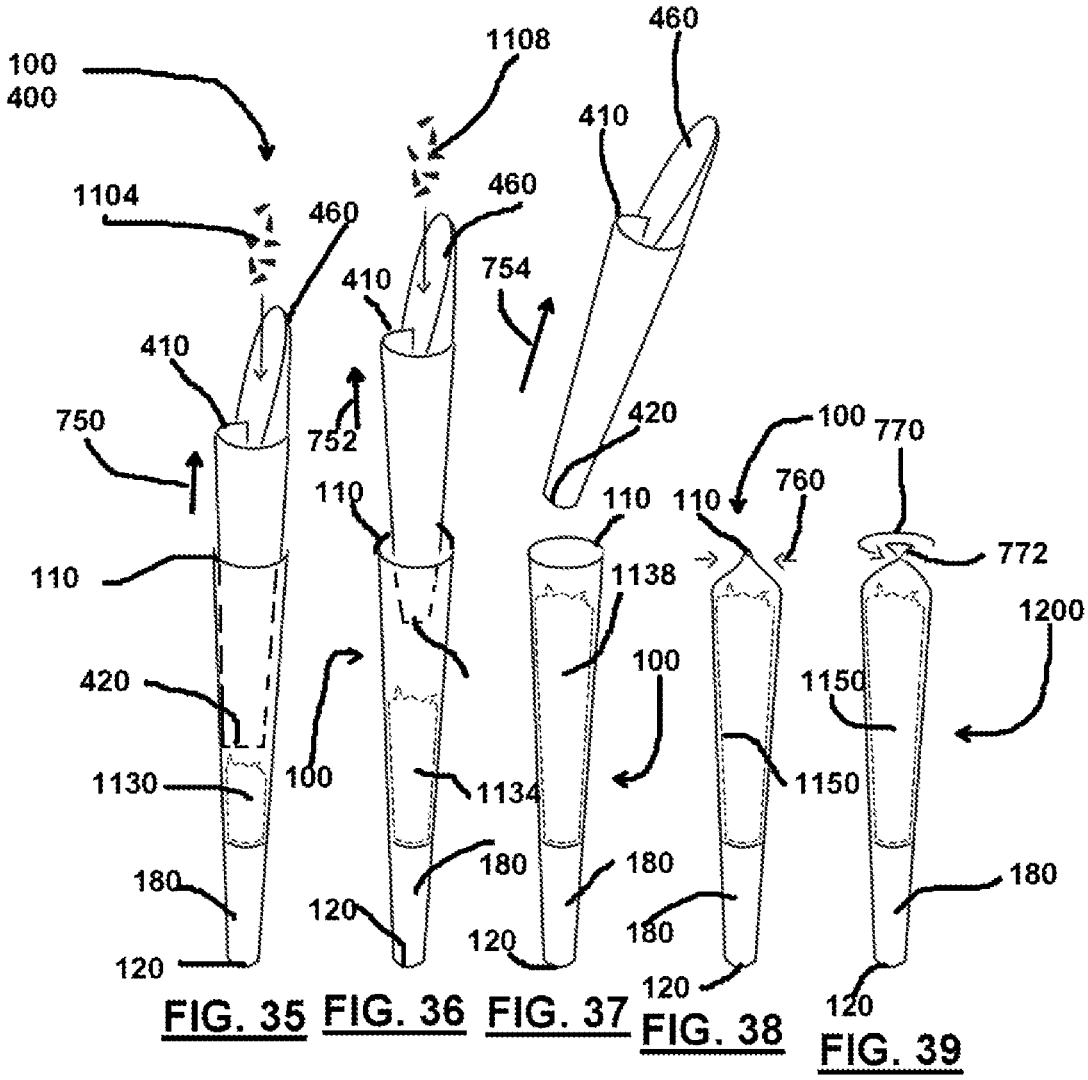
FIG. 35 is a perspective view of the first cone with outer support, wherein the first cone is partially filled with smokable filler material and the outer support is schematically shown as being partially removed from the first cone.
FIG. 36 is a perspective view of the first cone with outer support, wherein the first cone is now more partially filled with smokable filler material (compared to FIG. 26) and the outer support is now more partially removed from the first cone (compared to FIG. 26).
FIG. 37 is a perspective view of the first cone with outer support, wherein the first cone is now more filled with smokable filler material and the outer support is now completely removed from the first cone.
FIG. 38 is a perspective view of the first cone filled with smokable filler, and having the first end of the first cone pinched for closing.
FIG. 39 is a perspective view of the first cone filled with smokable filler, and having the first end of the first cone now twisted to complete a customized smokable product or cigar.

At this point the interior 114 of first cone 100 is filled with enough smokable filler for first cone 100 to be finished into a smokable cigar. FIGS. 35 through 39 summarize the steps of creating the customized finished cigar 1200. FIG. 35 is a perspective view of the first cone 100 with outer support 400, wherein the first cone 100 is partially filled with smokable filler material 1130 and the outer support 400 is partially removed (schematically indicated by arrow 750) from the first cone 100 during the filing and tamping process. FIG. 36 is a perspective view of the first cone 100 with outer support 400, wherein the first cone 100 is now more partially filled with smokable filler material 1134 and the outer support 400 is now more partially removed from the first cone 100 (schematically indicated by arrow 752). FIG. 37 is a perspective view of the first cone 100 with outer support 400, wherein the first cone 100 is now completely filled with smokable filler material 1138 and the outer support 400 is now completely removed from the first cone 100. FIG. 38 is a perspective view of the first cone 100 filled with smokable filler 1150, and having the first end 110 of the first cone 100 pinched for closing (schematically indicated by arrows 760). FIG. 39 is a perspective view of the first cone 100 filled with smokable filler 1150, and having the first end 110 of the first cone 100 now twisted (schematically indicated by arrow 770) to complete a customized smokable product or cigar 1200.

At this point the user can repackage the second cone 200 in flexible pouch 800 for later use, and utilize outer 400 and inner 500 supports to maintain the conical shape of second cone 200 while in flexible pouch. The steps for repackaging second cone 200 are described below.

Figures 40, 41, 42, 43, 44, 45, 46:
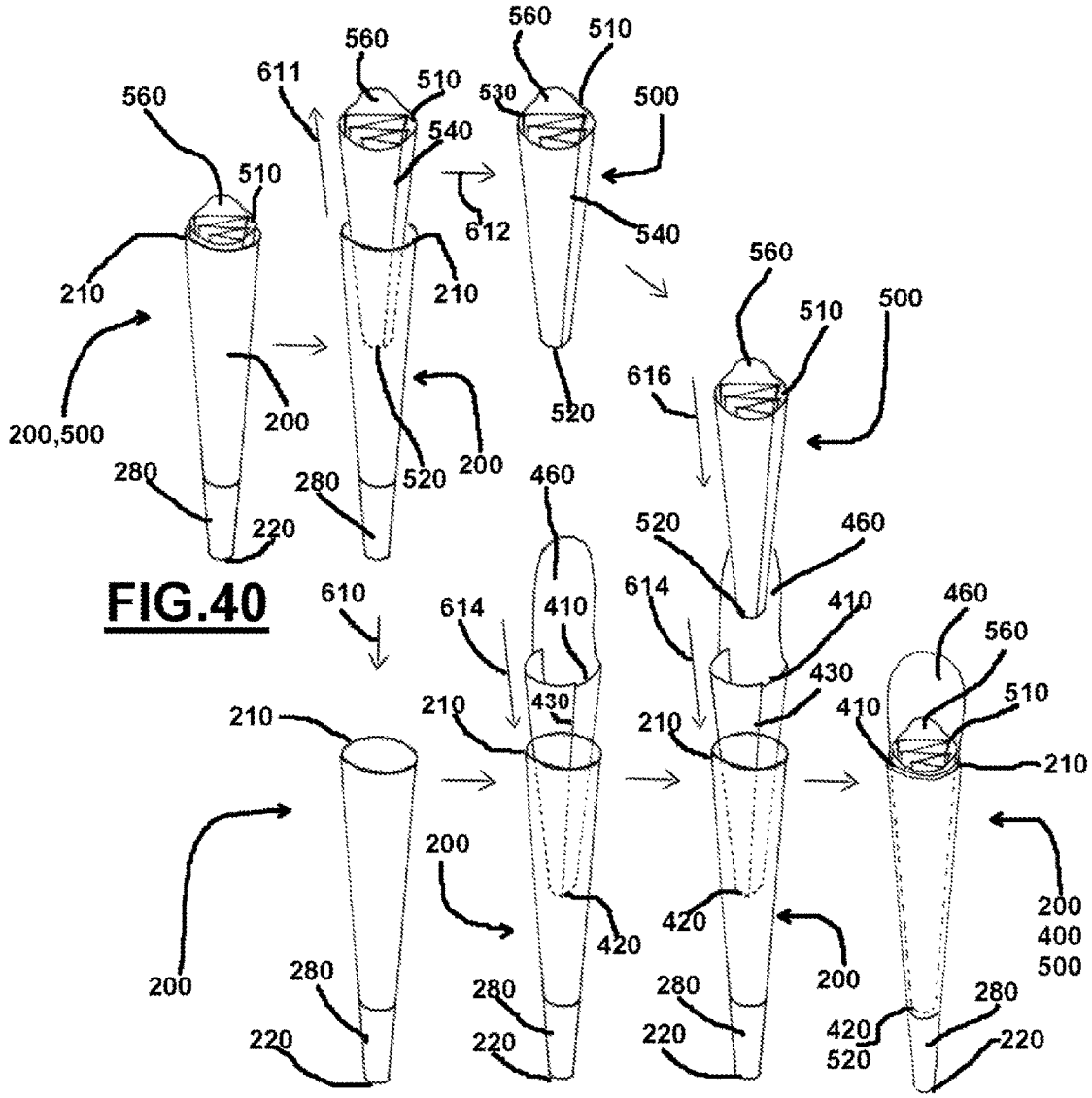
FIG. 40 is a perspective view of the second cone with inner support by itself.
FIG. 41 is a perspective view of the second cone, with inner support schematically shown as being partially removed from the second cone.
FIG. 42 is a perspective view of the inner support now completely removed from the second cone.
FIG. 43 is a perspective view of the second cone now with the inner support removed.
FIG. 44 is a perspective view of the second cone now with the outer support schematically shown as being partially inserted into the second cone.
FIG. 45 is a perspective view of the inner support schematically shown as being partially inserted into the partially inserted outer support; and both to be inserted in the interior of the second cone.
FIG. 46 is a perspective view of the inner support now inserted into the outer support, and the outer support now inserted into the second cone.
Figure 47:
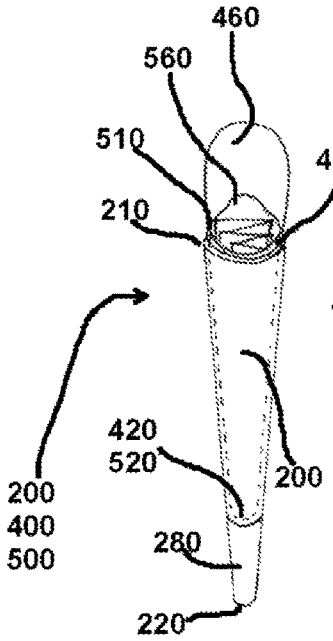
FIG. 47 is a perspective view of the inner support now inserted into the outer support, and the outer support now inserted into the second cone.
Figure 48:
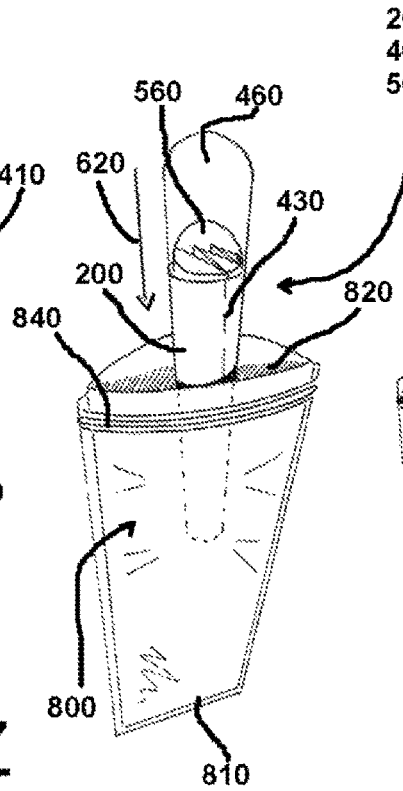
FIG. 48 is a perspective view of the second cone of FIG. 47 being partially reinserted into the open packaging of FIG. 19.
Figure 49:
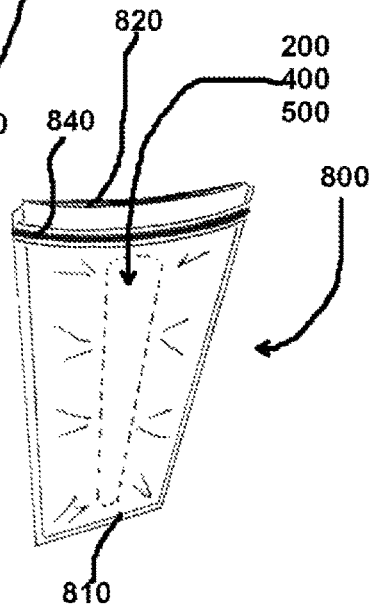
FIG. 49 is a perspective view of the second cone of FIG. 47 now fully reinserted into the open packaging of FIG. 19, and the packaging re-sealed for freshness.

FIG. 40 is a perspective view of the second cone 200 with inner support 500 by itself. FIG. 41 is a perspective view of the second cone 200 with inner support 500 being now being partially removed from the second cone 200. FIG. 42 is a perspective view of the inner support 500 now removed from the second cone 200. FIG. 43 is a perspective view of the second cone 200 now with the inner support 500 removed. FIG. 44 is a perspective view of the second cone now 200 with the outer support 400 being partially inserted into the second cone 200. FIG. 45 is a perspective view of the inner support 500 being partially inserted into the partially inserted outer support 400 both of which are inside the second cone 200. FIG. 46 is a perspective view of the inner support 500 now inserted into the outer support 400 now inserted into the second cone 200. FIG. 47 is a perspective view of the inner support 500 now inserted into the outer support 400 now inserted into the second cone 200. FIG. 48 is a perspective view of the second cone 200 being partially reinserted into the open packaging 800. FIG. 49 is a perspective view of the second cone 200 now fully reinserted into the open packaging 800, and the packaging 800 re-sealed for freshness.

Figure 50:
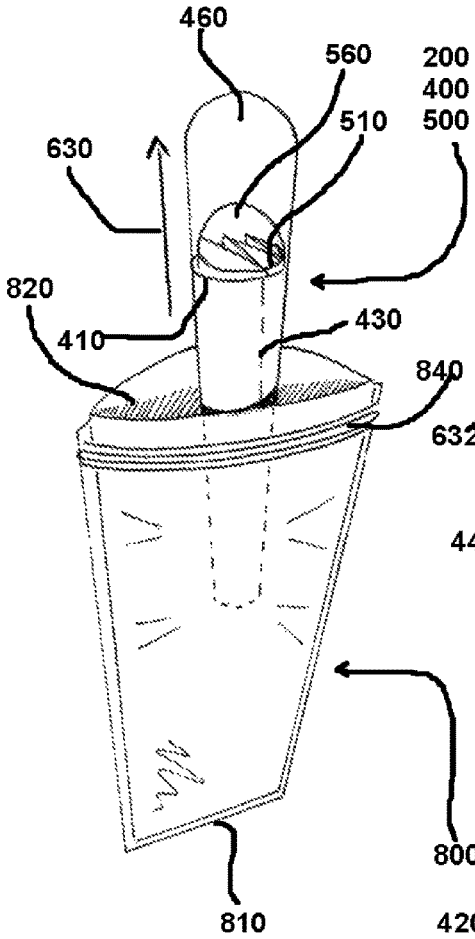
FIG. 50 is a perspective view of the packaging of FIG. 49, wherein the packaging has been opened again and the second cone is being partially removed.
Figure 51:
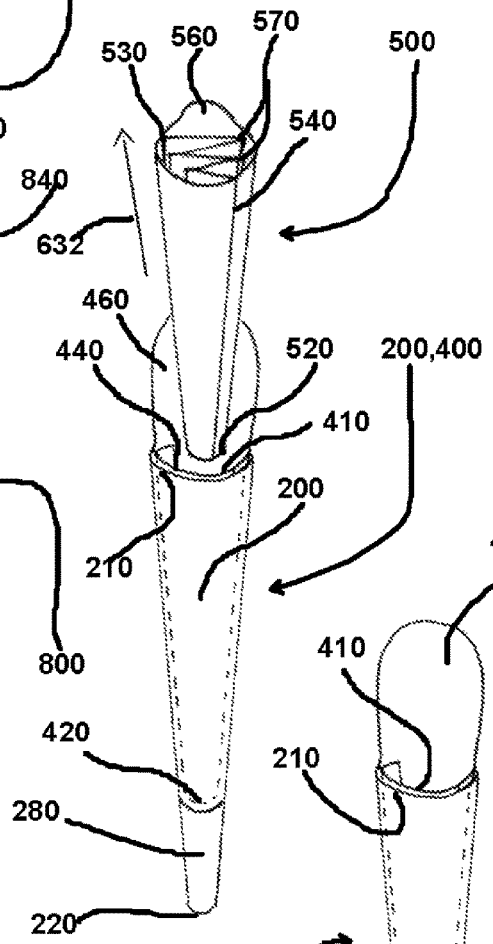
FIG. 51 is a perspective view of the second cone of FIG. 49 now removed from the packaging of FIG. 49, wherein the inner support has been partially removed from the second cone, but the outer support remains in the interior of the second cone.
Figure 52:
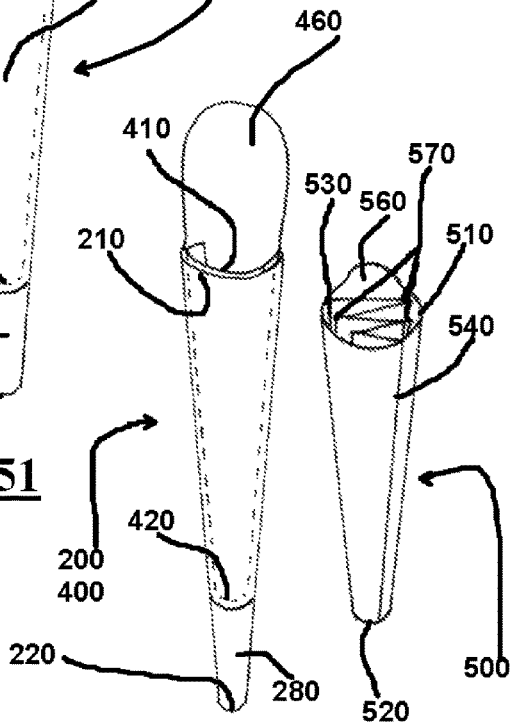
FIG. 52 is a perspective view of the second cone of FIG. 42 wherein the inner support has been completely removed from the second cone, but the outer support remains in the interior of the second cone.
Figures 53, 54:
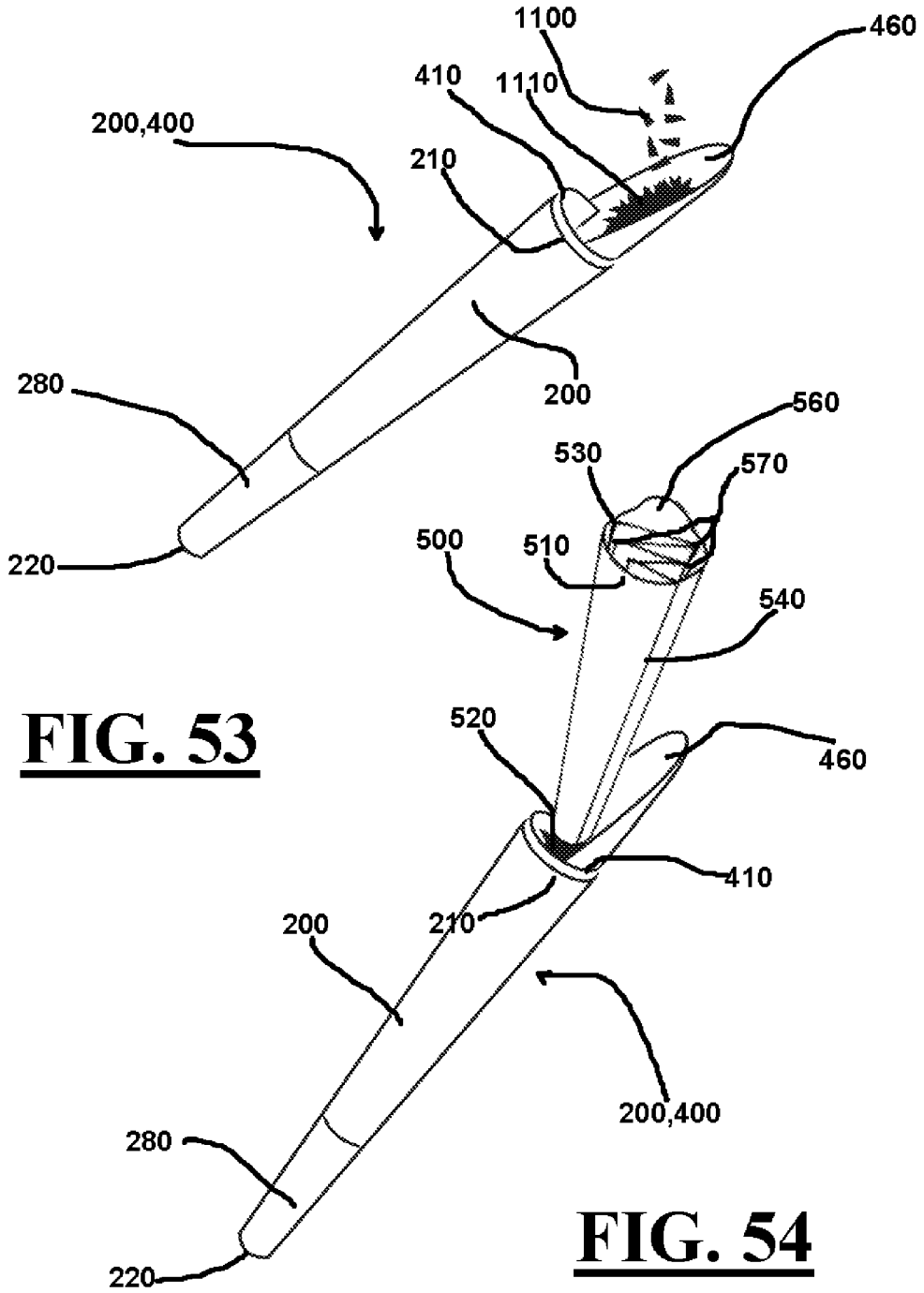
FIG. 53 is a perspective view of the second cone with outer support being filled with smokable filler.
FIG. 54 is a perspective view of the inner support being used as a tamping device to stuff or tamp down the smokable filler added to the second cone shown in FIG. 44.
Figures 55, 56, 57, 58:
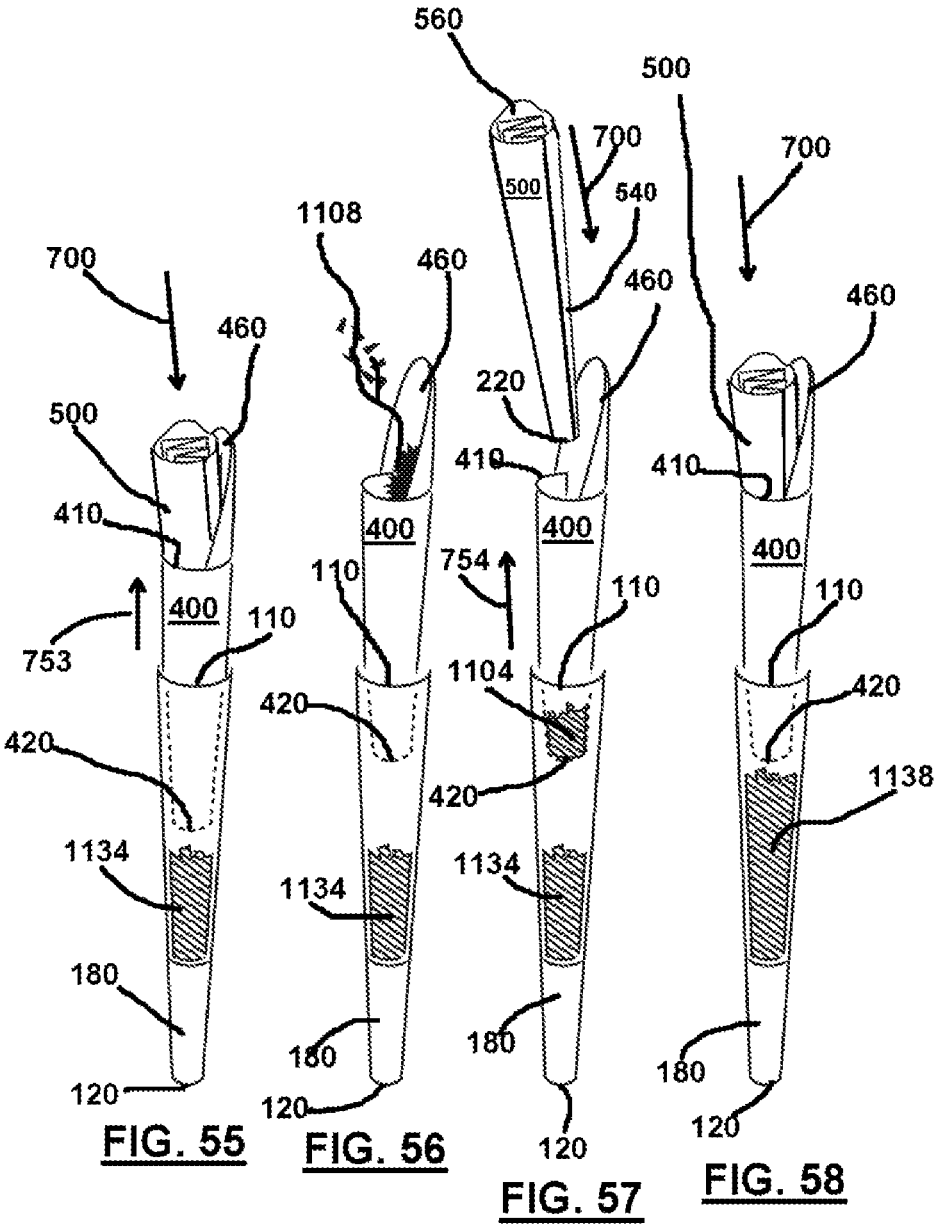
FIG. 55 is a perspective view of the second cone with outer support, wherein smokable filler has been tamped through the outer support and is in the bottom of the interior of the second cone causing it to be partially filled with smokable filler material, and showing the outer support partially pulled up longitudinally relative to the second cone to facilitate the filling and tamping process.
FIG. 56 is a perspective view of the second cone with outer support being filled with additional smokable filler.
FIG. 57 is a perspective view of the second cone with outer support, wherein the additional smokable filler added in FIG. 56 is at the lower end of the outer support and the second support is being used to tamp said additional smokable filler into the interior of the cone.
FIG. 58 is a perspective view of the second cone with outer support, wherein the additionally added smokable filler has now been tamped through the outer support and is in the bottom of the interior of the second cone causing the interior to be additionally partially filled with smokable filler material, and showing the outer support being additionally partially pulled up relative to the second cone as compared to FIGS. 55-57 to continue the filling and tamping process.

One embodiment includes the steps for creating a customized smokable product with the second 200 cone with outer 400 and inner 500 supports will now be described. FIG. 50 is a perspective view of the packaging 800 with second cone 200, wherein the packaging 800 has been opened again and the second cone 200 is partially removed. FIG. 51 is a perspective view of the second cone 200 now removed from the packaging 800, wherein the inner support 500 has been partially removed from the second cone 200, but the outer support 400 remains in second cone 200. FIG. 52 is a perspective view of the second cone 200 wherein the inner support 500 has been completely removed from the second cone 200, but the outer support 400 remains in second cone 200. FIG. 53 is a perspective view of the second cone 200 with outer support 400 being filled with smokable filler 1100. FIG. 54 is a perspective view of the inner support 500 being used as a tamping device to stuff or tamp down the smokable filler 1100 added to the second cone 200 with outer support 400. FIG. 55 is a perspective view of the second cone 200 with outer support 400, wherein smokable filler 1100 has been tamped through the outer support 400 and is in the bottom of the second cone 200 causing it to be partially filled with smokable filler material 1100, and showing the outer support 400 partially removed from the second cone 200. FIG. 56 is a perspective view of the second cone 200 with outer support 400 being filled with additional smokable filler 1100. FIG. 57 is a perspective view of the second cone 200 with outer support 400, wherein the additional smokable filler 1100 is at the lower end of the outer support 400, and the inner support 500 is being used to tamp said additional smokable filler into the cone 200. FIG. 58 is a perspective view of the second cone 200 with outer support 400, wherein the additionally added smokable filler 1100 has now been tamped through the outer support 400, and is in the bottom of the second cone 200 causing it to be additionally partially filled with smokable filler material 1100, and showing the outer support 400 additionally partially removed from the second cone 200 as compared to FIGS. 55-57.

Figures 59, 60, 61, 62, 63:
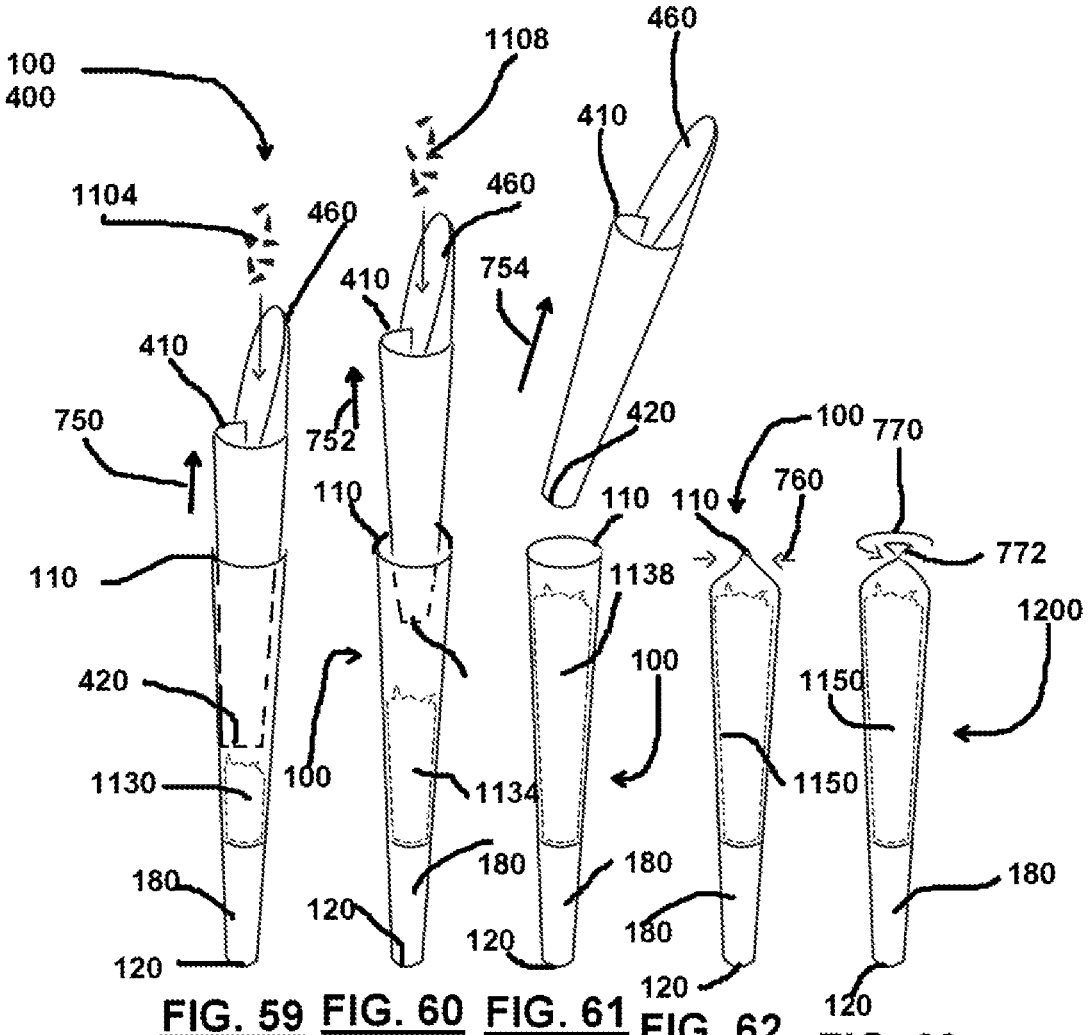
FIG. 59 is a perspective view of the second cone with outer support, wherein the second cone is partially filled with smokable filler material and the outer support is partially pulled up relative to the second cone to facilitate the filling and tamping process.
FIG. 60 is a perspective view of the second cone with outer support, wherein the interior of the second cone is now more partially filled with smokable filler material (compared to FIG. 59) and the outer support is now more partially pulled up relative to the second cone (compared to FIG. 59) to continue to facilitate the filling and tamping process.
FIG. 61 is a perspective view of the second cone with outer support, wherein interior of the second cone is now more filled with smokable filler material and the outer support is now completely removed from the second cone.
FIG. 62 is a perspective view of the second cone filled with smokable filler, and having the first end of the second cone pinched for closing.
FIG. 63 is a perspective view of the second cone filled with smokable filler, and having the first end of the second cone now twisted to complete a customized smokable product or cigar.

FIG. 59 is a perspective view of the second cone 200 with outer support 400, wherein the second cone 200 is partially filled with smokable filler material 1100, and the outer support 400 is partially removed from the second cone 200. FIG. 60 is a perspective view of the second cone 200 with outer support 400, wherein the second cone 200 is now more partially filled with smokable filler material 1100 (compared to FIG. 59), and the outer support 400 is now more partially removed from the second cone 200 (compared to FIG. 59). FIG. 61 is a perspective view of the second cone 200 with outer support 400, wherein the second cone 200 is now more filled with smokable filler material 1100, and the outer support 400 is now removed from the second cone 200. FIG. 62 is a perspective view of the second cone 200 filled with smokable filler 1100, and having the first end 210 of the second cone pinched for closing (schematically indicted by arrows 760). FIG. 63 is a perspective view of the second cone 200 filled with smokable filler 1100, and having the first end 210 of the second cone 200 now twisted (schematically indicated by arrow 770) to complete a customized smokable product or cigar 1200'.

Figure 64:
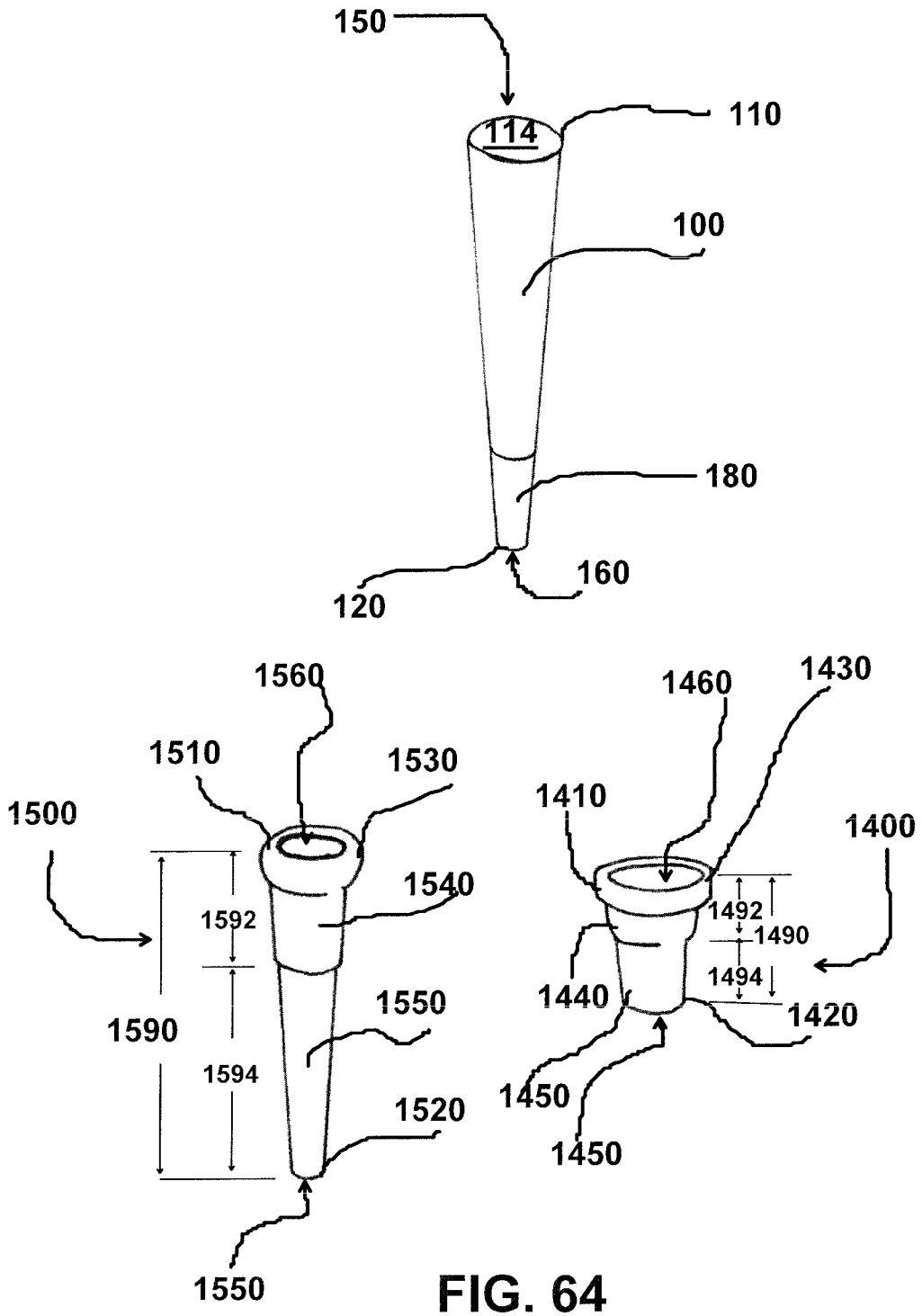
FIG. 64 includes perspective views of the first cone by itself and alternative embodiments for the outer and inner supports.

Alternative Embodiment Using Plastic or Other Substantially Stiff Inner and Outer Supports FIG. 64 includes perspective views of the first cone 100 by itself and alternative embodiments for the outer 1400 and inner 1500 supports.

Outer support 1400 can include first end 1410 and second end 1420 and be tapered, conical or frustoconically shaped. Outer support 1400 can include interior 1460 between first end 1410 and second end 1420. At first end 1410 can be supporting enlarged lip or ring area 1430. Adjacent first end 1410 can be enlarged conical area 1440. Between second end 1420 and enlarged area 1440 can be reduced conical area 1450. Outer support 1400 can have an overall length 1490. Enlarged conical area 1440 can have a length 1492 and reduced conical area 1450 can have a length 1494. In various embodiments length 1490 can be less than 50 percent of the longitudinal length of first cone 100 (either including or not including filter 180 length). In various embodiments length 1490 can be less than 45, 40, 30, 25, 20, 15, 10, and 5 percent of the longitudinal length of first cone 100 (either including or not including filter 180 length). In various embodiments length 1490 can be between any two of the above referenced percentages of the longitudinal length of first cone 100 (either including or not including filter 180 length). The shorter the length 1490 the less that outer support 1400 will interfere with smokable filler being added to first 100 and second 200 cones while outer support provides circumferential ring support to first 100 and second 200 cones at their first ends 110,210 during the filling and tamping process.

Inner support 1500 can include first end 1510 and second end 1520 and be tapered, conical or frustoconically shaped. Inner support can include interior 1560 between first end 1510 and second end 1520. At first end can be supporting enlarged lip or ring area 1530. Adjacent first end 1510 can be enlarged conical area 1540. Between second end 1520 and enlarged area 1540 can be reduced conical area 1550. Inner support 1500 can have an overall length 1590. Enlarged conical area 1540 can have a length 1592 and reduced conical area 1550 can have a length 1594. In various embodiments length 1590 can be greater than 35 percent of the longitudinal length of second cone 200 (either including or not including filter 280 length). In various embodiments the longitudinal length of second cone 200 can be the same as the longitudinal length of first cone 100. In various embodiments length 1590 can be greater than 40, 45, 50, 55, 60, 65, 70, 75, 80, 85, 90, and 95 percent of the longitudinal length of second cone 200 (either including or not including filter 280 length). In various embodiments length 1590 can be between any two of the above referenced percentages of the longitudinal length of second cone 200 (either including or not including filter 280 length).

Figure 65:
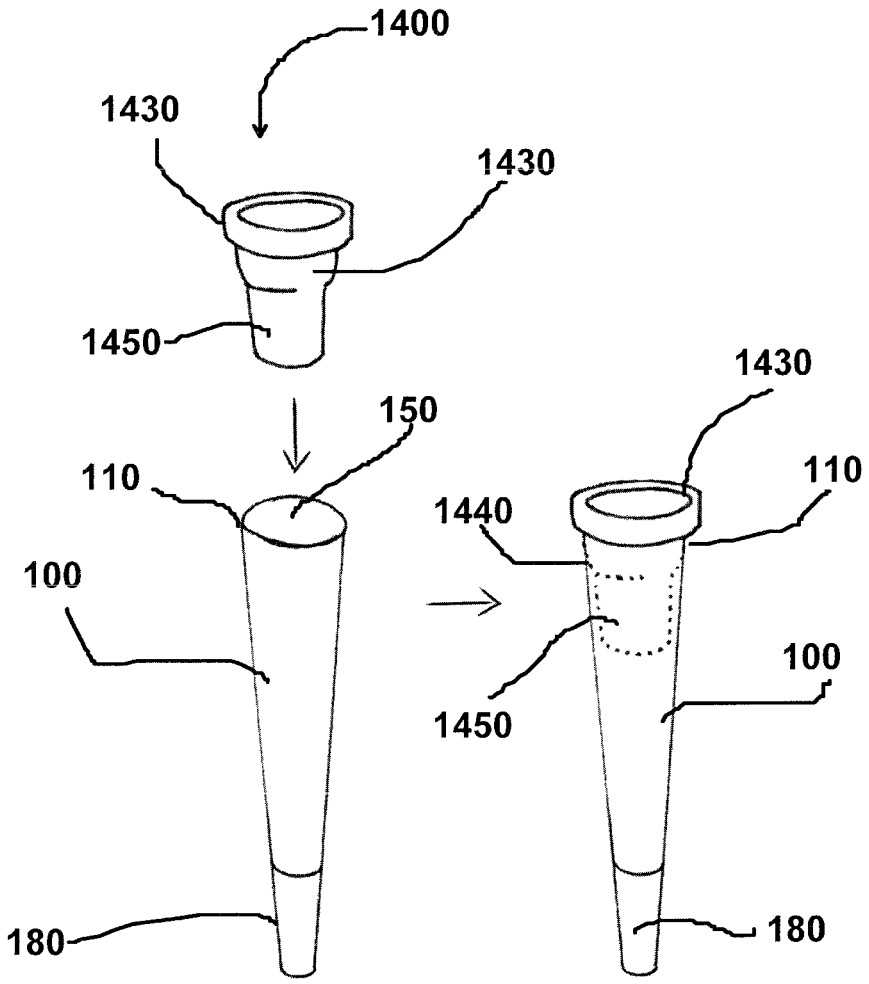
FIG. 65 includes perspective views schematically showing the outer support being inserted into the first cone.

FIG. 65 includes perspective views schematically showing the outer support 1400 being inserted into the first cone 100.

Figure 66:
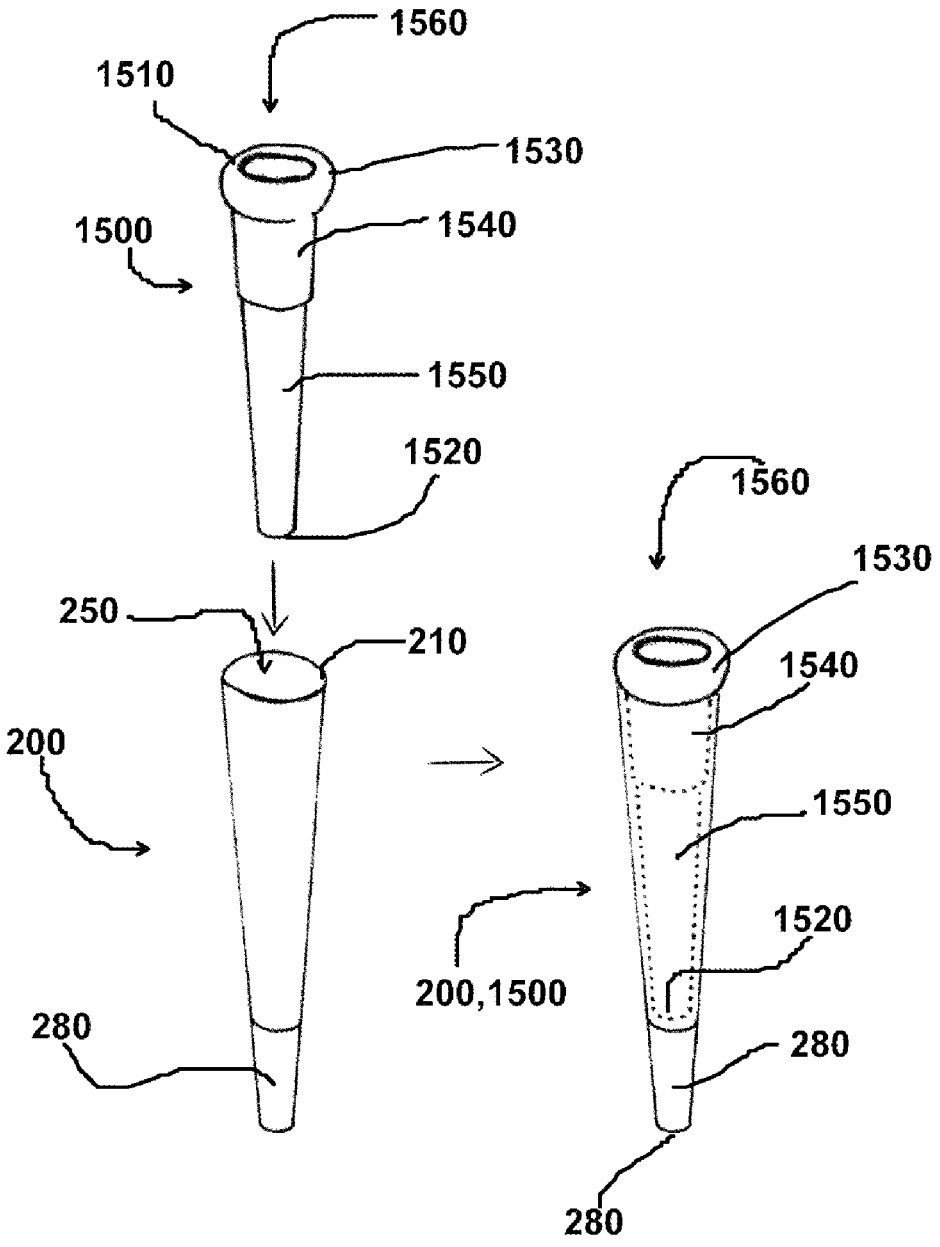
FIG. 66 includes perspective views schematically showing the inner support being inserted into the second cone.

FIG. 66 includes perspective views schematically showing the inner support 1500 being inserted into the second cone 200.

Figure 67:
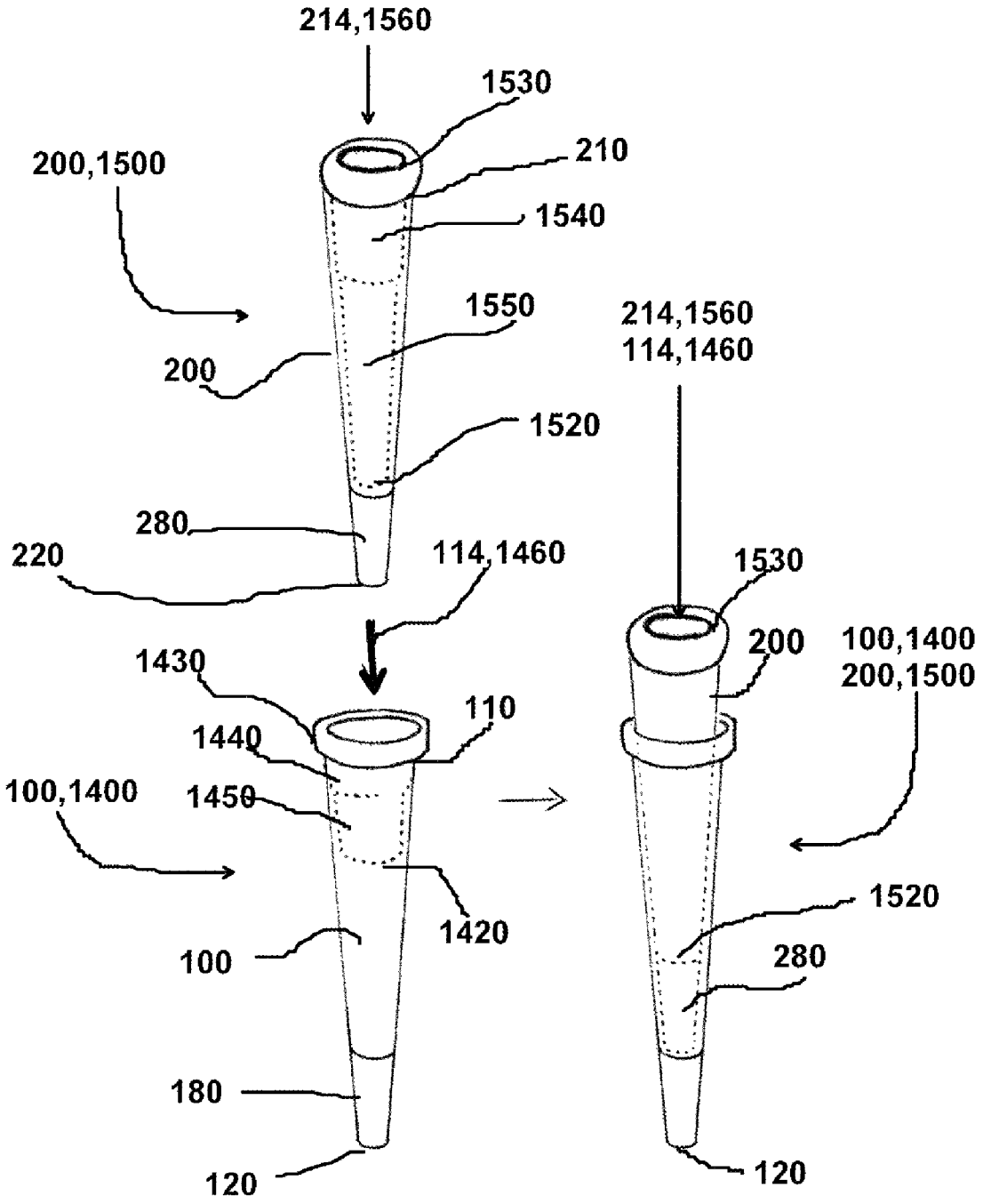
FIG. 67 includes perspective views schematically showing the combination inner support/second cone of FIG. 66 being inserted into the combination outer support/first cone of FIG. 65.

FIG. 67 includes perspective views schematically showing the combination inner support/second cone 1500/200 being inserted into the combination outer support/first cone 1400/100.

Figure 68:
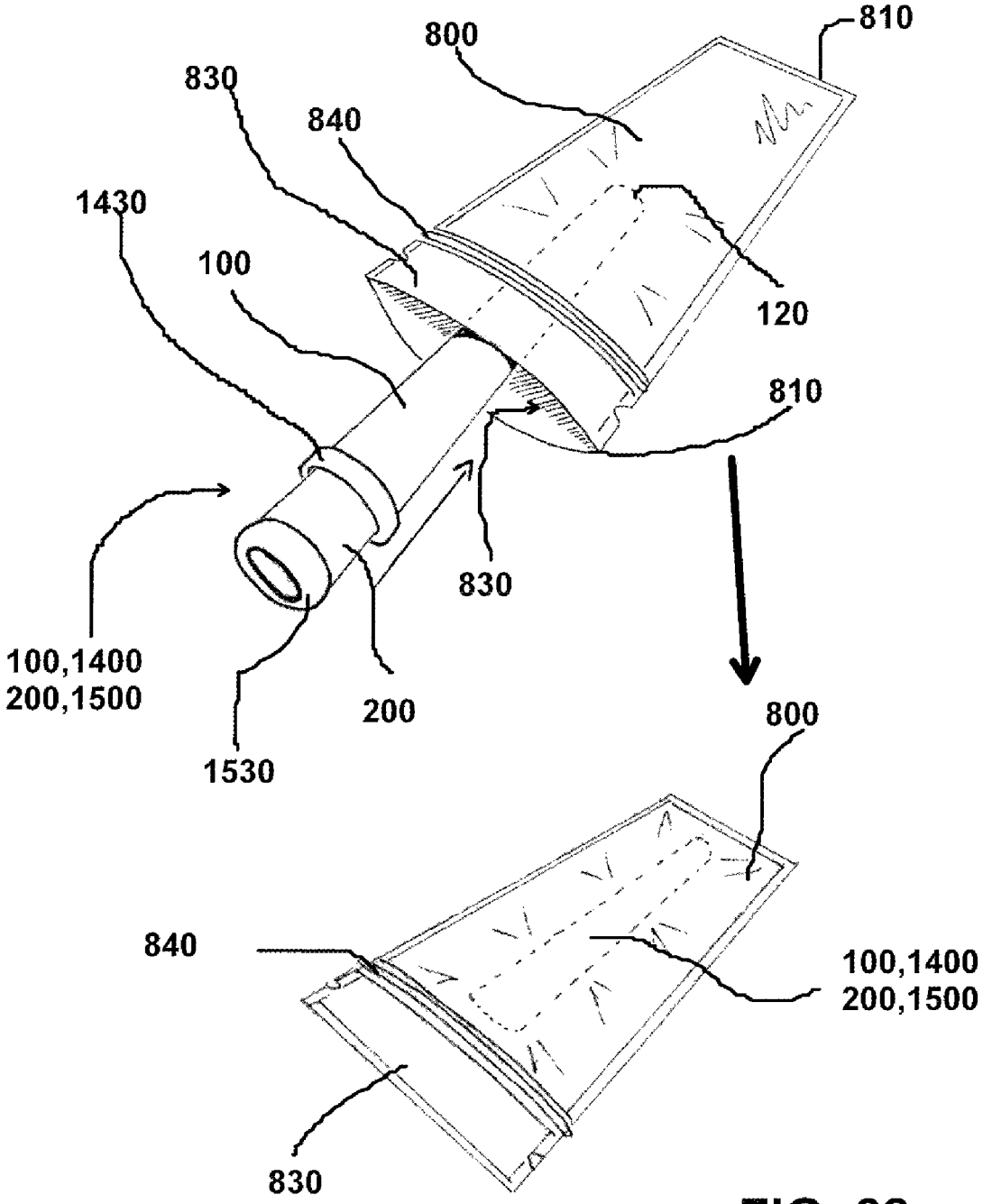
FIG. 68 includes perspective views schematically showing the combination inner support/second cone/outer support/first cone of FIGS. 66 and 67 being inserted into packaging and the packaging being sealed for sale.

FIG. 68 includes perspective views schematically showing the combination inner support/second cone/outer support/first cone 1500/200,1400/100 being inserted into packaging 800 and the packaging being 800 sealed for sale.

Figure 69:
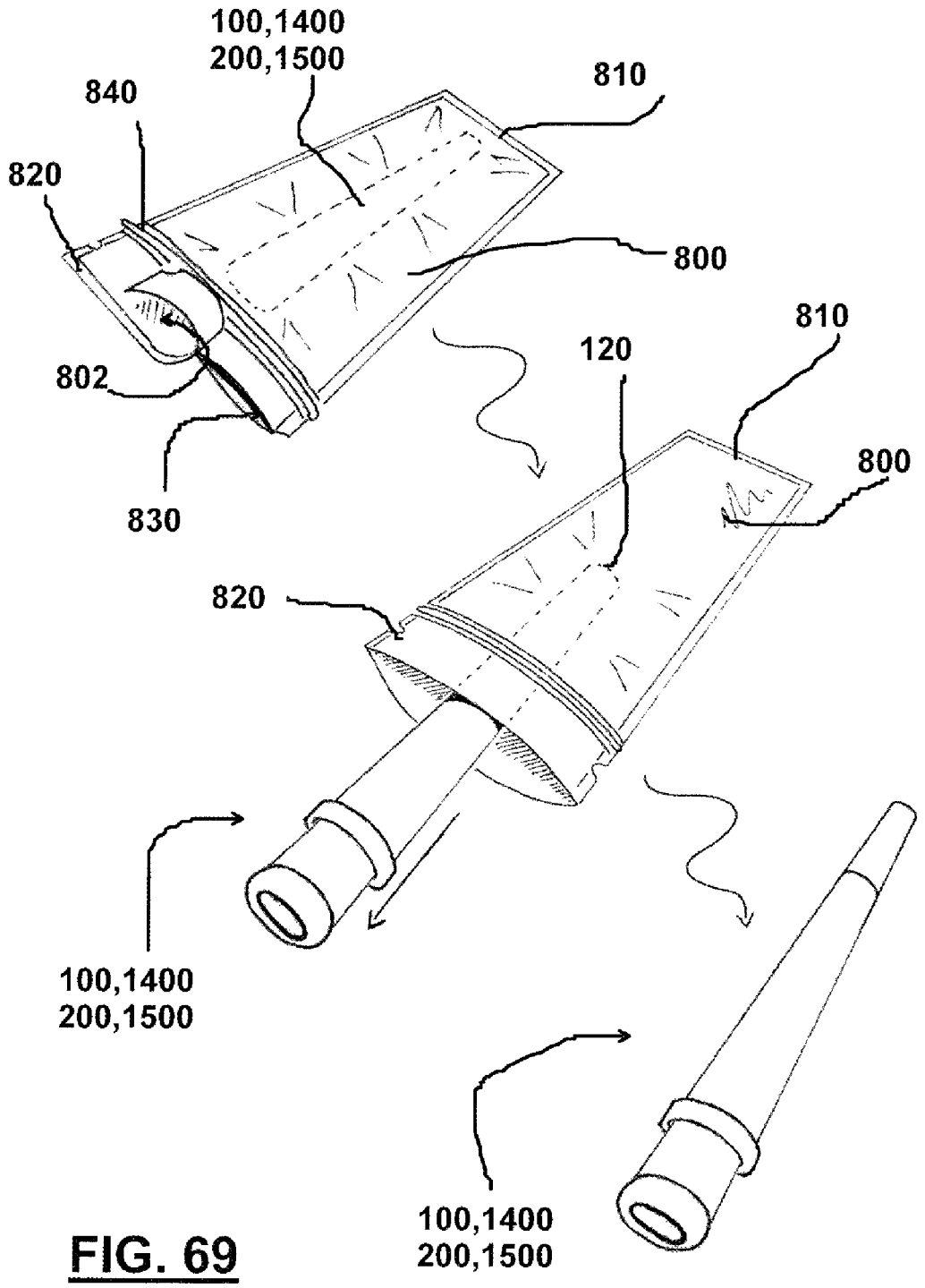
FIG. 69 includes perspective view schematically showing the packaging of FIG. 68 being opened and the combination inner support/second cone/outer support/first cone of FIGS. 66 and 67 being removed from the packaging for making a custom smoking product.

FIG. 69 includes perspective view schematically showing the packaging 800 being opened and the combination inner support/second cone/outer support/first cone 500/200,1400/100 being removed from the packaging 800 for making a custom smoking product.

Figures 70, 71, 72, 73:
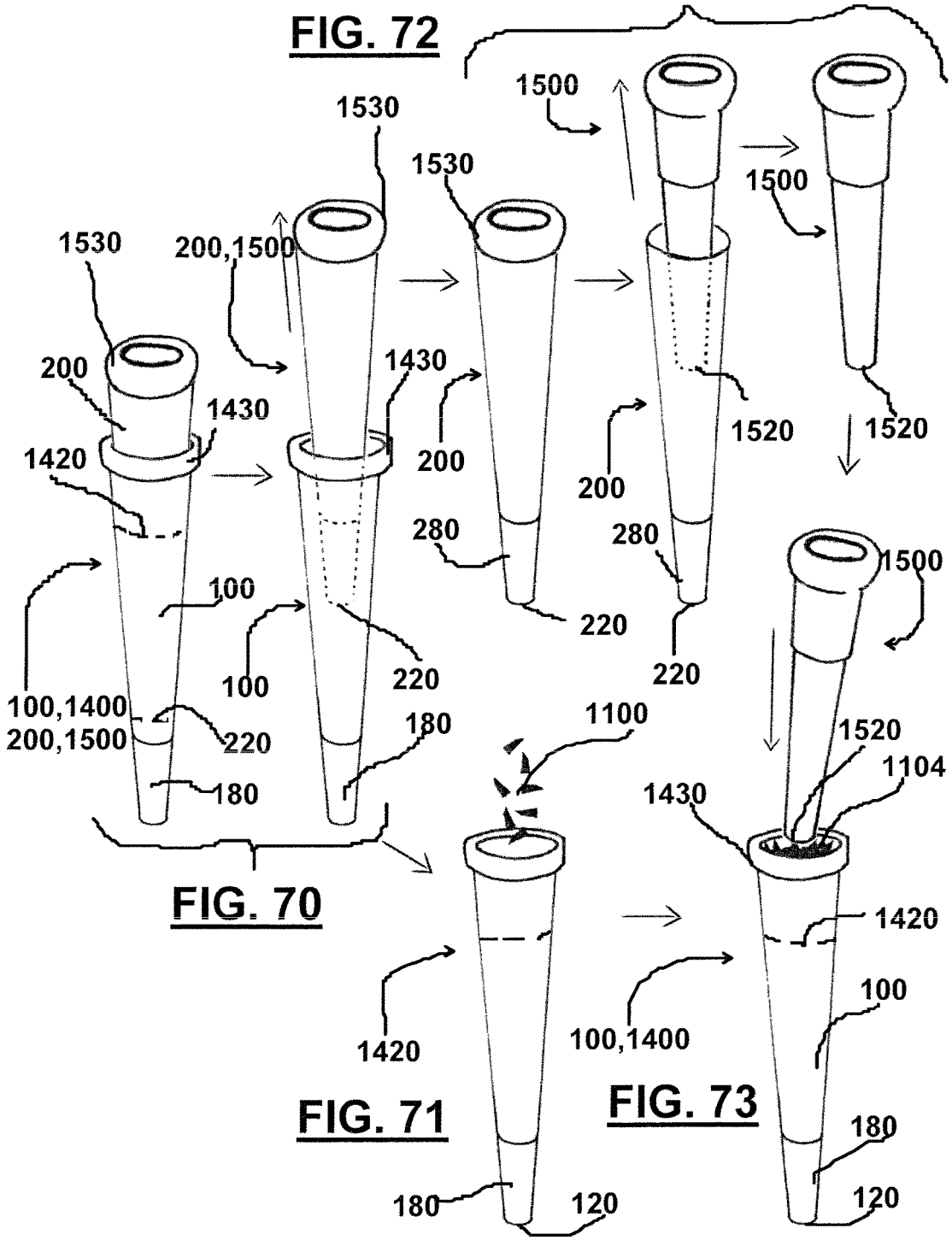
FIG. 70 includes perspective view schematically showing combination inner support/second cone/outer support/first cone of FIGS. 66 and 67 being separated into the combination inner support/second cone of FIG. 67 and combination outer support/first cone of FIG. 66.
FIG. 71 schematically shows the tobacco filler being added to the combination outer support/first cone of FIG. 70.
FIG. 72 includes perspective views schematically showing the inner support being separated from the second cone.
FIG. 73 schematically shows the inner support being used to tamp or push down the tobacco filler added in FIG. 71.

FIG. 70 includes perspective view schematically showing combination inner support/second cone/outer support/first cone 500/200,1400/100 being separated into the combination inner support/second cone 1500/200 and combination outer support/first cone 1400/200.

FIG. 71 schematically shows the tobacco filler 1100 being added to the combination outer support/first cone 1400/200.

FIG. 72 includes perspective views schematically showing the inner support 1500 being separated from the second cone 200.

FIG. 73 schematically shows the inner support 1500 being used to tamp or push down the tobacco filler 1100.

Figures 74, 75, 76:
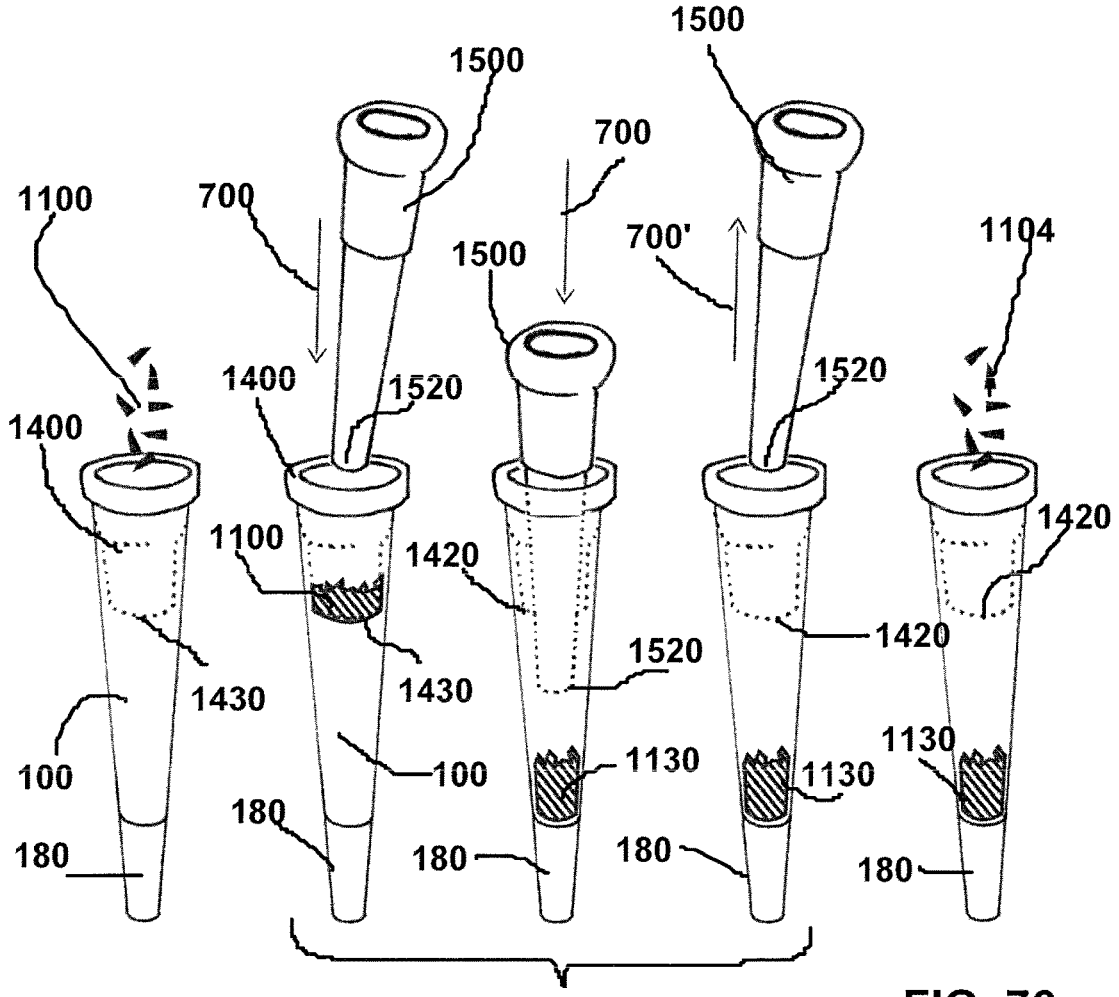
FIG. 74 is another perspective view of the first cone with outer support being filled with smokable filler of FIG. 71.
FIG. 75 includes perspective views of the first cone with outer support inserted, wherein inner support is sequentially shown to successfully tamp or push the smokable filler through the lower end of the outer support, then showing this tamped filler at the bottom of the interior of the first cone, causing the first cone to be partially filled with smokable filler material, and also showing the inner support being removed so that additional tobacco filler can be added to the first cone through the opening of the outer support.
FIG. 76 is perspective view of the first cone with outer support being filled with more smokable filler (compared to FIGS. 74 and 75), and showing the previously tamped smokable filler (from FIG. 75) in the interior of the first cone.

FIG. 74 is another perspective view of the first cone 100 with outer support 1400 being filled with smokable filler 1100.

FIG. 75 includes perspective views of the first cone 100 with outer support 1400 inserted, wherein inner support 1500 is sequentially shown to successfully tamp or push the smokable filler 1100 through the lower end 1420 of the outer support 1400, then showing this tamped filler 1130 at the bottom of the interior 114 of the first cone 100, causing the first cone 100 to be partially filled with smokable filler material, and also showing the inner support 1500 being removed so that additional tobacco filler 1104 can be added to the first cone 100 through the opening 1450 of the outer support 1400.

FIG. 76 is perspective view of the first cone 100 with outer support 1400 being filled with more smokable filler 1104, and showing the previously tamped smokable filler 1130 in the interior 114 of the first cone 100.

Figures 77, 78:
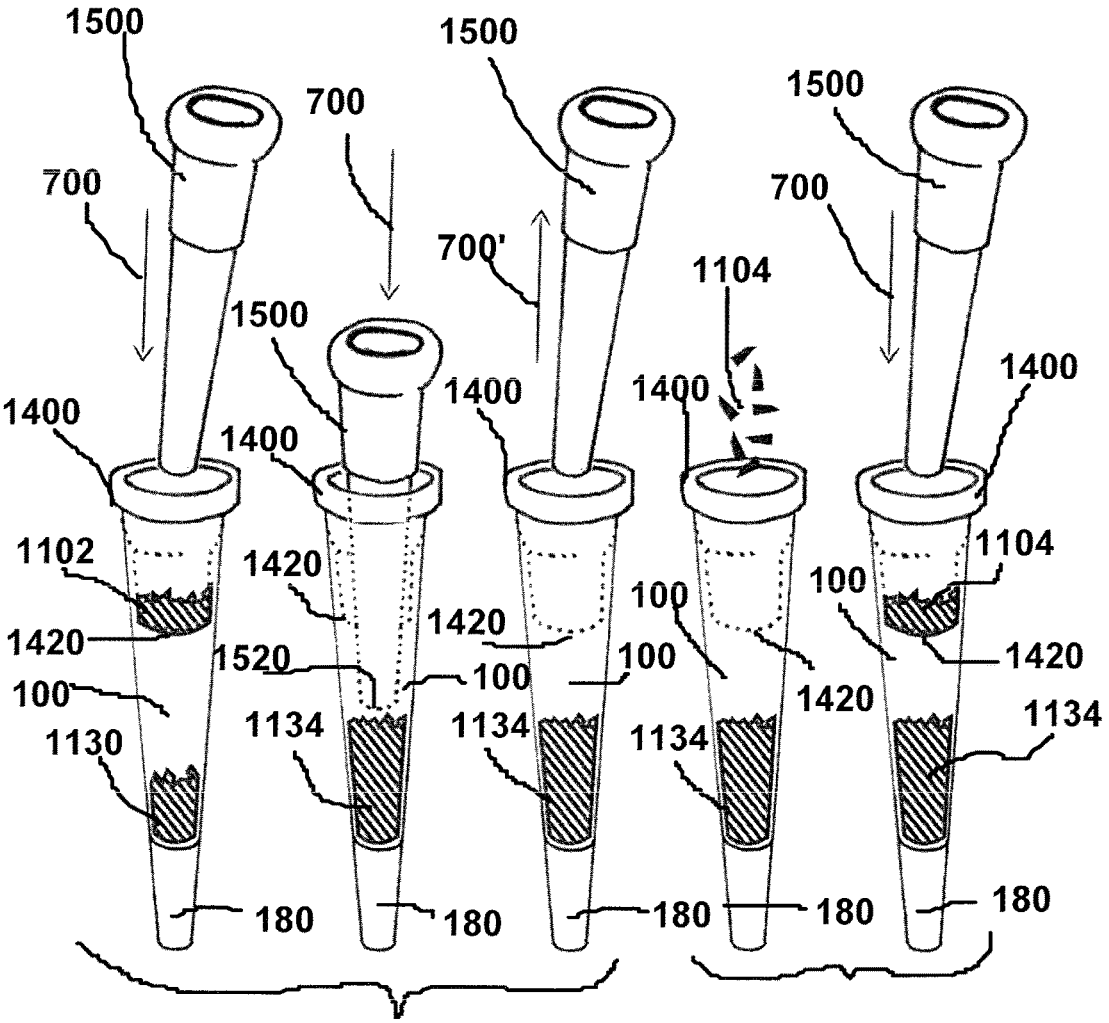
FIG. 77 includes perspective views of the first cone with outer support, wherein the inner support is shown to successfully tamp or push the smokable filler added in FIG. 76 through the lower end of the outer support which then combines in the interior of the first cone with the previously tamped smokable filler (from FIG. 76), and also showing the inner support being removed for another step of adding tobacco filler and tamping for a continuation of the tamping and filling process.
FIGS. 78 and 79 include perspective views of the first cone with outer support, wherein additional tobacco filler is placed into the first cone through the inner support and such additional tobacco filler to be successfully tamped or pushed through the lower end of the outer support to combine in the interior of the first cone with the previously tamped smokable filler, and also showing the inner support being removed for another step of adding tobacco filler and tamping for a continuation of the tamping and filling process.

FIG. 77 includes perspective views of the first cone 100 with outer support 1400, wherein the inner support 1500 is shown to successfully tamp or push the smokable filler 1104 through the lower end 1420 of the outer support 1400 which then combines (combined filler 1134) in the interior 114 of the first cone 100 with the previously tamped smokable 1130, and also showing the inner support 1500 being removed for another step of adding tobacco filler 1104 and tamping for a continuation of the tamping and filling process.

Figures 79, 80, 81:
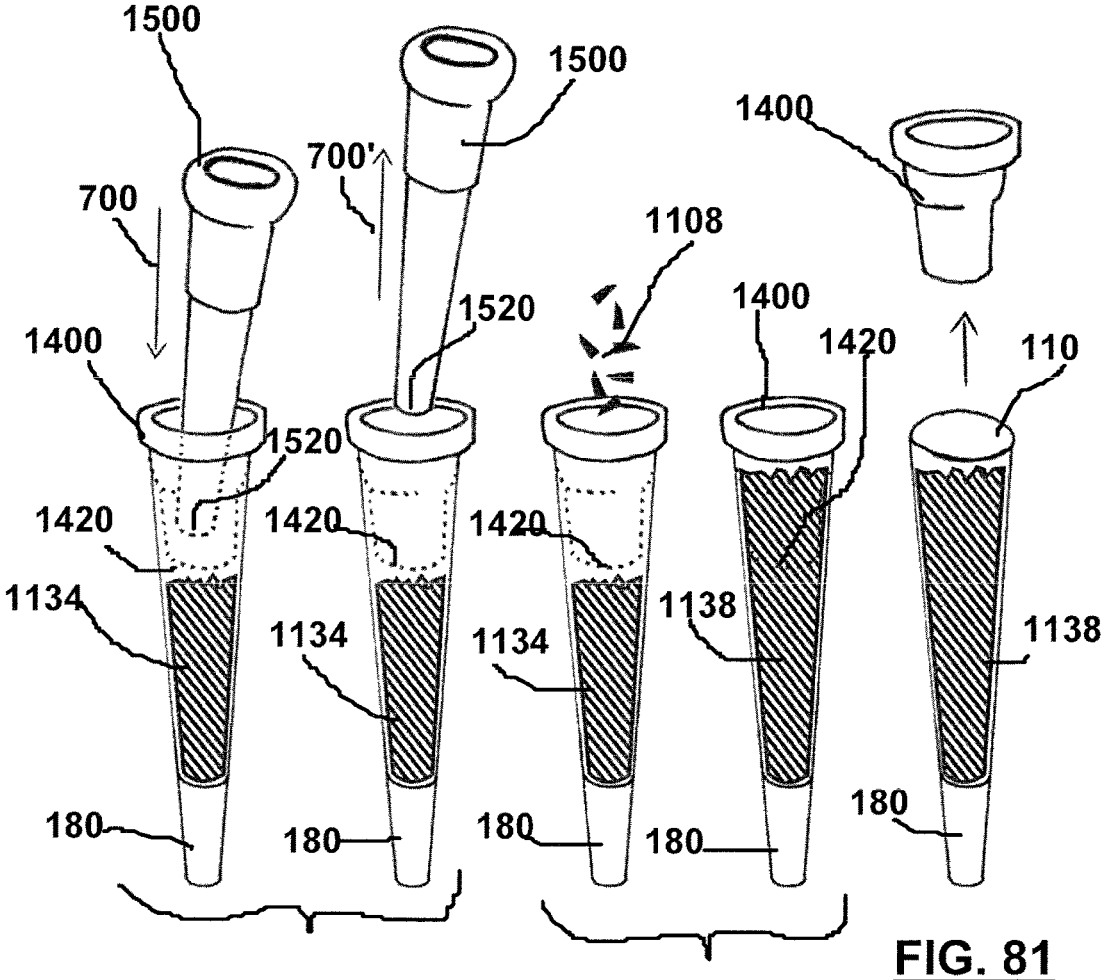
FIG. 80 includes perspective views of the first cone with outer support, additional tobacco filler is added to the first cone through the outer support and this additional tobacco filler can be tamped through using the inner support.
FIG. 81 is a perspective view of the outer support being removed from the first cone after the first cone has been filled with tobacco filler as described in the previous steps.

FIGS. 78 and 79 include perspective views of the first cone 100 with outer support 1400, wherein additional tobacco filler 1108 is placed into the first cone 100 through the inner support 1400 and such additional tobacco filler 1104 to be successfully tamped or pushed through the lower 1420 end of the outer support 1400 to combine in the interior 114 of the first cone 100 with the previously tamped smokable filler (1134), and also showing the inner support 1500 being removed for another step of adding tobacco filler and tamping for a continuation of the tamping and filling process.

FIG. 80 includes perspective views of the first cone 100 with outer support 1400, additional tobacco filler 1108 is added to the first cone 100 through the outer support 1400 and this additional tobacco filler 1400 can be tamped through using the inner support 1500.

FIG. 81 is a perspective view of the outer support 1400 being removed from the first cone 100 after the first cone 100 has been filled with tobacco filler 1138 as described in the previous steps.

Figure 82:
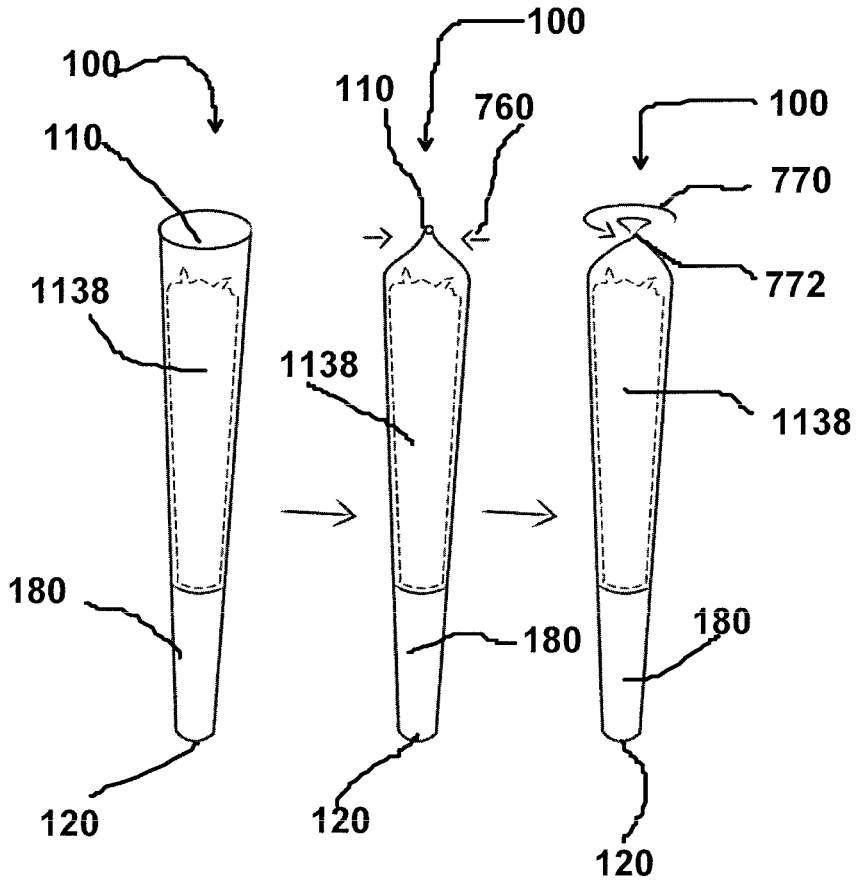
FIG. 82 includes perspective views schematically showing the first cone filled with smokable filler, this filled first cone having the first end of the first cone pinched for closing, and then this pinched end now twisted to complete a customized smokable product or cigar.

FIG. 82 includes perspective views schematically showing the first cone 100 filled with smokable filler 1138, this filled first cone 100 having the first end 110 pinched for closing (schematically indicated by arrows 760), and then this pinched end 110 now twisted (schematically indicated by arrow 772) to complete a customized smokable product or cigar.

Figure 83:
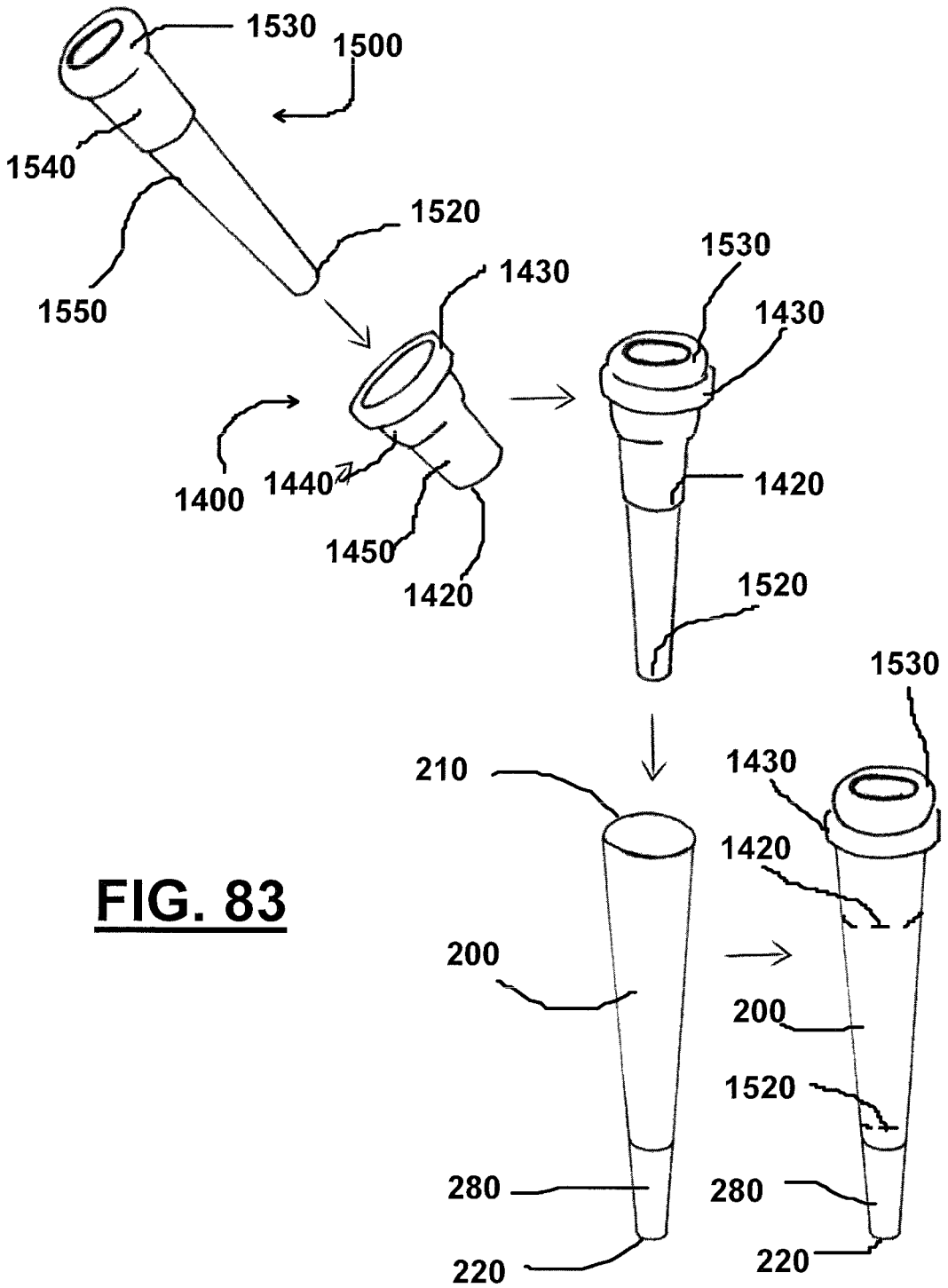
FIG. 83 includes perspective views schematically showing steps of repackaging the second cone with outer and inner supports, which includes inserting the inner support into the outer support, and then inserting the combination inner support/outer support into the second cone.

FIG. 83 includes perspective views schematically showing steps of repackaging the second cone 200 with outer 1400 and inner 1500 supports, which includes inserting the inner support 1500 into the outer support 1400, and then inserting the combination inner support/outer support 1500/1400 into the second cone 200.

Figure 84:
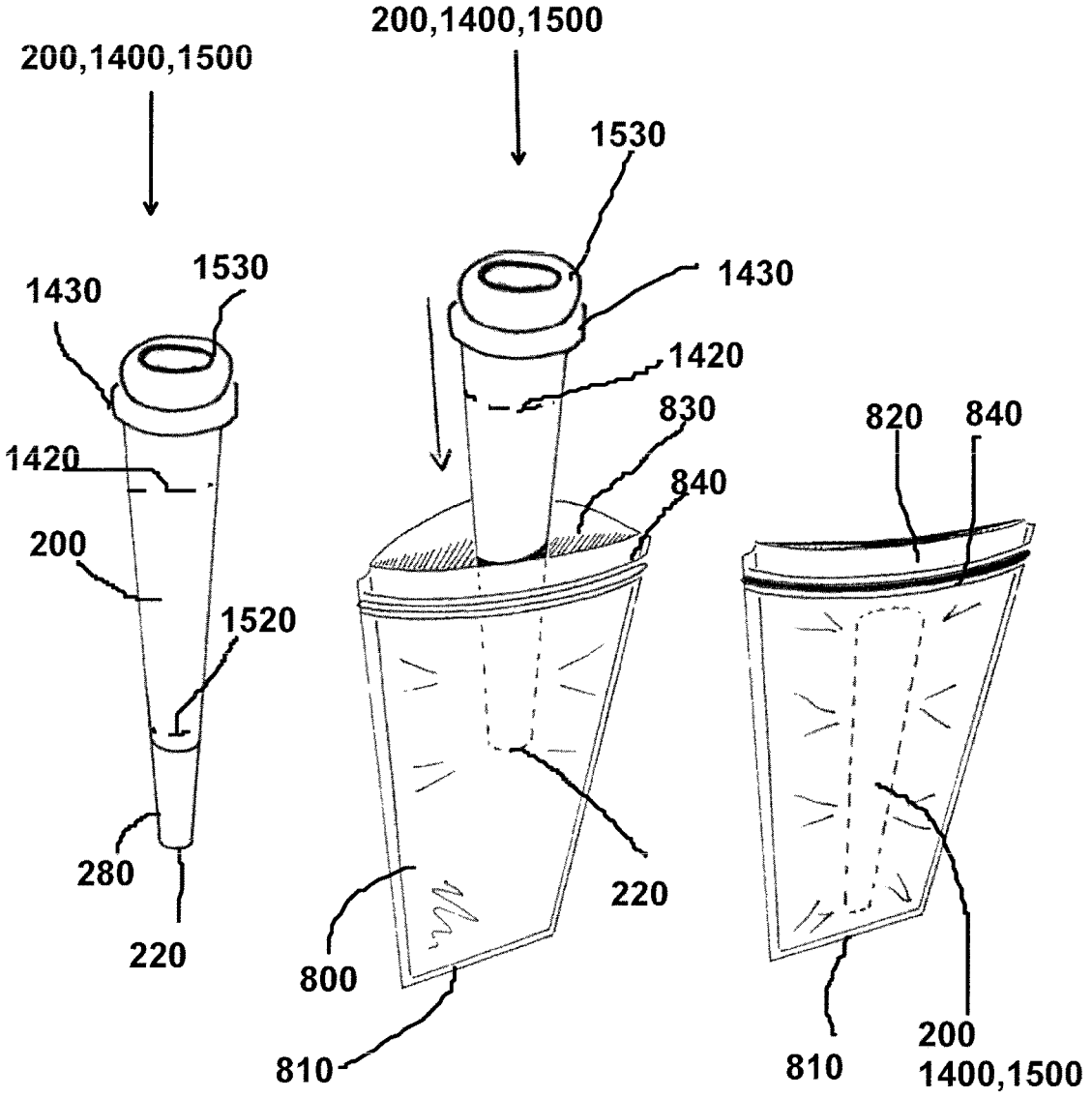
FIG. 84 includes perspective views schematically showing the combination inner support/outer support/second cone of FIG. 83 being reinserted into packaging and the packaging being sealed for sale.

FIG. 84 includes perspective views schematically showing the combination inner support/outer support/second cone 1500/1400/200 being reinserted into packaging 800 and the packaging being sealed for sale.

Figure 85:
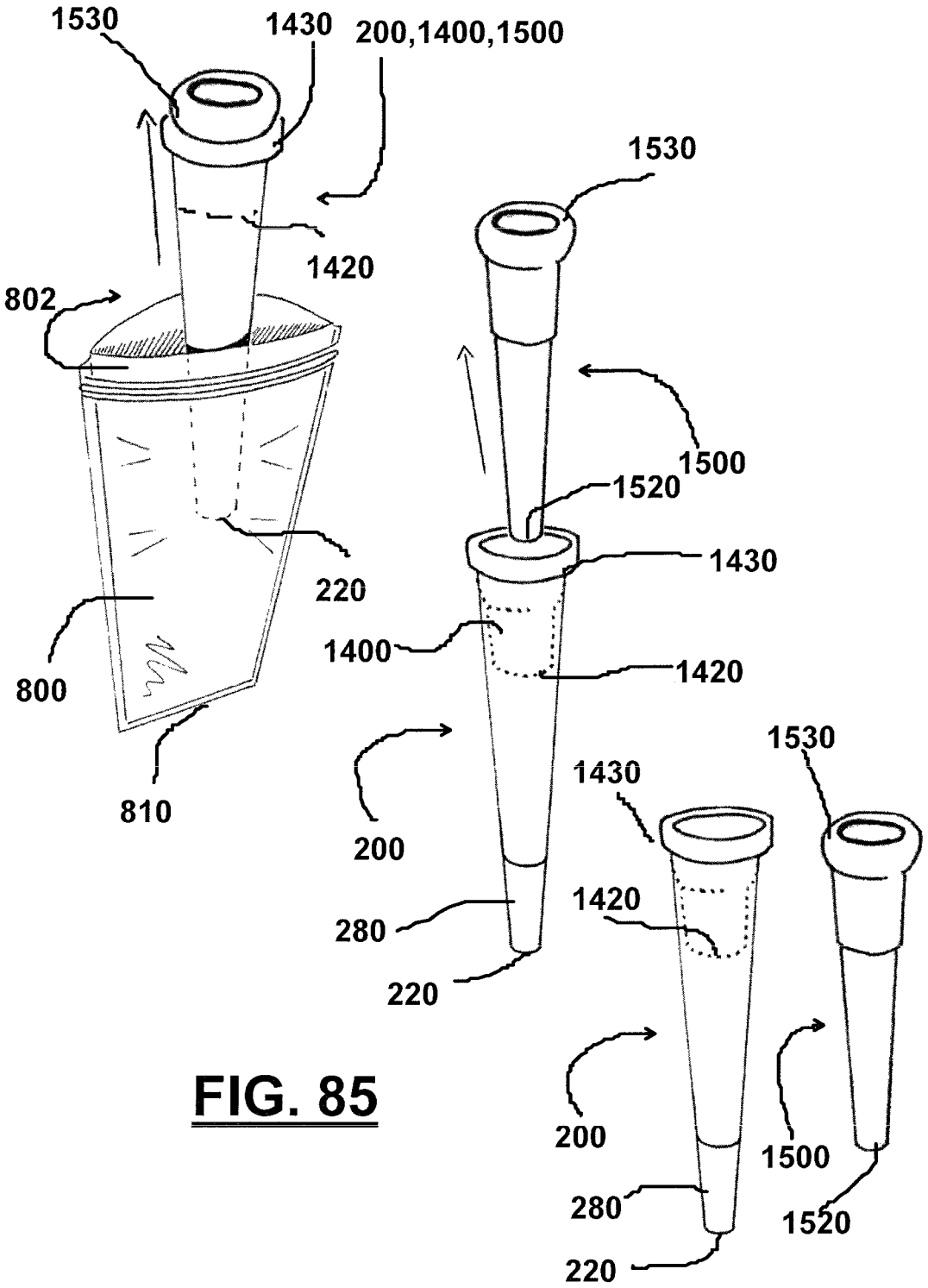
FIG. 85 includes perspective views schematically showing the packaging of FIG. 84 being opened and the combination inner support/outer support/second cone of FIG. 82 being removed from the packaging for making a second custom smoking product. The steps for this constructing the second custom smoking product are substantially the same as those describe for first cone and FIGS. 70 through 84.

FIG. 85 includes perspective views schematically showing the packaging 800 being opened and the combination inner support/outer support/second cone 1500/1400/200 being removed from the packaging for making a second custom smoking product. The steps for this constructing the second custom smoking product are substantially the same as those describe for first cone and FIGS. 70 through 84.

The following is a Table of Reference Numerals used in this patent application:

TABLE OF REFERENCE NUMERALS:

| REFERENCE NUMBER | DESCRIPTION |
|---|---|
| 10 | smoking article |
| 100 | hollow cone |
| 110 | first end |
| 114 | interior |
| 120 | second end |
| 130 | inner surface |
| 140 | outer surface |
| 150 | first opening |
| 160 | second opening |
| 180 | filter |
| 200 | hollow cone |
| 210 | first end |
| 214 | interior |
| 220 | second end |
| 230 | inner surface |
| 240 | outer surface |
| 250 | first opening |
| 260 | second opening |
| 280 | filter |
| 400 | sheet of material |
| 402 | first side |
| 402 | second side |
| 410 | first end |
| 420 | second end |
| 430 | first edge |
| 440 | second edge |
| 460 | tab or lip |
| 490 | arrow |
| 492 | arrow |
| 500 | sheet of material |
| 510 | first end |
| 520 | second end |
| 530 | first side |
| 540 | second side |
| 560 | tab or lip |
| 570 | plurality of perforation lines, lines, or etched areas |
| 590 | arrow |
| 592 | arrow |
| 594 | arrow |
| 596 | arrow |
| 597 | arrow |
| 598 | arrow |
| 600 | arrow |
| 602 | arrow |
| 610 | arrow |
| 611 | arrow |
| 612 | arrow |
| 614 | arrow |
| 616 | arrow |
| 620 | arrow |
| 630 | arrow |
| 632 | arrow |
| 700 | arrow |
| 750 | arrow |
| 752 | arrow |
| 754 | arrow |
| 760 | arrow |
| 770 | arrow |
| 772 | twisted knot or pigtail |
| 800 | package/wrapper |
| 802 | arrow |
| 810 | closed end |
| 820 | open end |
| 830 | interior |
| 840 | seal |
| 1000 | pouch/container |
| 1100 | smokable material |
| 1110 | portion of smokable material being poured |
| 1120 | portion of smokable material on tab |
| 1124 | portion of smokable material in support |
| 1130 | portion of smokable material pushed by stuffer or tamper |

-continued

TABLE OF REFERENCE NUMERALS:

| REFERENCE NUMBER | DESCRIPTION |
|---|---|
| 1132 | portion of smokable material pushed by stuffer or tamper |
| 1134 | portion of smokable material pushed by stuffer or tamper |
| 1150 | filled smokable material |
| 1150 | filled portion |
| 1200 | smoker |
| 1400 | outer support |
| 1410 | first end |
| 1420 | second end |
| 1430 | enlarged rim |
| 1440 | enlarged area |
| 1450 | reduced area |
| 1460 | interior bore |
| 1490 | overall length |
| 1492 | length of enlarged area |
| 1494 | length of reduced area |
| 1500 | inner support |
| 1510 | first end |
| 1520 | second end |
| 1530 | enlarged rim |
| 1540 | enlarged area |
| 1550 | reduced area |
| 1560 | interior bore |
| 1490 | overall length |
| 1492 | length of enlarged area |
| 1494 | length of reduced area |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A packaged cigar apparatus that generates two smokable articles, comprising:

a) a package having
an interior and
an end portion with a sealed opening;

b) first and second shells,
each being a hollow, conically shaped smokable shell, each with a shell interior;

c) a first reinforcing cone
that is able to occupy a position within
the shell interior of the first smokable shell,
the first reinforcing cone having
a stiffness that is greater than
the stiffness of the first smokable shell;

d) wherein the first reinforcing cone has first and second ends and a longitudinal centerline, with
an open ended hollow bore
extending from the first to the second end, and
a tab extending from the second end in a direction substantially parallel to the longitudinal centerline,
the tab having an inner concave surface with a centerline that is substantially parallel to the longitudinal centerline;

e) a second reinforcing cone
that fits inside the of the second smokable shell,
the second reinforcing cone having a second reinforcing cone interior with one or more of transversely positioned panels located inside the second reinforcing cone interior and causing the second reinforcing cone to have a stiffness that is greater than the stiffness of the first reinforcing cone; and f) wherein the shells and reinforcing cones are packaged inside the package interior as an assembly wherein the first reinforcing cone occupies the shell interior of the first shell and the second reinforcing cone occupies the shell interior of the second shell, and the second shell occupies both the shell interior of the first shell and the open ended hollow bore of the first reinforcing cone.

2. The packaged cigar apparatus of claim 1, wherein in the second reinforcing cone there are multiple panels that are part of a sheet of folded reinforcing material, and the multiple panels serve as an obstruction to the second reinforcing cone interior.

3. The packaged cigar apparatus of claim 1, wherein one end portion of the first shell has a filter.

4. The packaged cigar apparatus of claim 1, wherein the open ended bore of the first reinforcing cone has a larger opening and a smaller opening.

5. The packaged cigar apparatus of claim 1, wherein the first reinforcing cone has upper and lower end portions, the upper end portion having a circumferentially extending edge, and the open ended hollow bore is free from obstructions.

6. The packaged cigar apparatus of claim 5, wherein a the tab extends from the edge.

7. The packaged cigar apparatus of claim 6, wherein the tab has a curved top edge.

8. A packaged cigar apparatus that generates two smokable articles, comprising:

a) a package having an interior and an end portion with a sealed opening;

b) first and second conically shaped smokable shells, each being a hollow conically shaped smokable shell, each with a shell interior;

c) a first reinforcing cone having first and second ends and an open interior, the first reinforcing cone being able to occupy a position within the shell interior of the first conically shaped smokable shell, the first reinforcing cone having a stiffness that is greater than the stiffness of the first conically shaped smokable shell;

d) wherein the first reinforcing cone has first and second ends and a longitudinal centerline with a tab extending in a direction substantially parallel to the longitudinal centerline, and a hollow cone shaped cone interior, the tab having an inner concave surface with a centerline that is substantially parallel to the longitudinal centerline;

e) a second reinforcing cone having first and second ends and a blocked interior, the second reinforcing cone being able to occupy a position with the shell interior of the second conically shaped smokable shell, the second reinforcing cone having a stiffness that is greater than the stiffness of the first reinforcing cone;

f) a push rod for enabling a user to compress tobacco that is placed within said first or said second conically shaped smokable shell; and g) wherein the first and second conically shaped smokable shells, first and second reinforcing cones, and push rod are packaged inside the package interior as an assembly wherein the first reinforcing cone occupies the shell interior of the first shell, and the tab portion of the reinforcing cone extends at least partially outside of the shell interior of the first conically shaped smokable shell, the second reinforcing cone occupies the shell interior of the second shell, the second shell occupies the interior of the first reinforcing cone, and when removed from the packaging the first and second conically shaped smokable shells generate two smokable articles.

* * * * *